US008241012B2

(12) United States Patent
Inoue et al.

(10) Patent No.: US 8,241,012 B2
(45) Date of Patent: Aug. 14, 2012

(54) STRUCTURE FOR MOUNTING A FILTER IN A COMPRESSOR

(75) Inventors: Yoshinori Inoue, Kariya (JP); Hiroyuki Nakaima, Kariya (JP); Yoichi Takashima, Kariya (JP); Kazuya Shinmyo, Kariya (JP); Atsuo Sakagami, Kariya (JP); Masaya Sakamoto, Kariya (JP); Satoshi Umemura, Kariya (JP); Naoki Koeda, Kariya (JP); Yuji Hashimoto, Kariya (JP); Hisaya Kondo, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 635 days.

(21) Appl. No.: 12/324,039

(22) Filed: Nov. 26, 2008

(65) Prior Publication Data

US 2009/0142202 A1 Jun. 4, 2009

(30) Foreign Application Priority Data

Nov. 29, 2007 (JP) ..... P2007-308283
Sep. 17, 2008 (JP) ..... P2008-237309
Nov. 12, 2008 (JP) ..... P2008-289559

(51) Int. Cl.
*F04B 53/20* (2006.01)
*B01D 35/30* (2006.01)

(52) U.S. Cl. ..... 417/269; 417/313; 210/232; 210/416.5

(58) Field of Classification Search ..... 417/269, 417/313; 210/232, 416.5
See application file for complete search history.

(56) References Cited

U.S. PATENT DOCUMENTS

| | | | | |
|---|---|---|---|---|
| 4,283,997 | A | 8/1981 | Takahashi et al. | 92/79 |
| 5,630,939 | A * | 5/1997 | Bulard et al. | 210/416.1 |
| RE35,672 | E * | 11/1997 | Taguchi | 417/222.2 |
| 2005/0008499 | A1 * | 1/2005 | Umemura et al. | 417/222.2 |
| 2005/0129536 | A1 | 6/2005 | Ohtake | 417/313 |
| 2007/0186524 | A1 * | 8/2007 | Pearson et al. | 55/486 |

FOREIGN PATENT DOCUMENTS

| | | |
|---|---|---|
| JP | 2002-276544 | 9/2002 |
| JP | 2002-285966 | 10/2002 |
| JP | 2005-264828 | 9/2005 |

* cited by examiner

*Primary Examiner* — Devon C Kramer
*Assistant Examiner* — Dominick L Plakkoottam
(74) *Attorney, Agent, or Firm* — Locke Lord LLP

(57) ABSTRACT

In a structure for mounting a filter in a compressor, a mounting member is connected to the filter. A receiving hole is formed in a housing of the compressor for receiving therein the mounting member. A first fitting portion is formed on an inner circumferential surface of a holding portion of the filter. A second fitting portion is formed on an outer circumferential surface of the mounting member for having fitting relation to the first fitting portion for an overlap distance in a radial direction of the receiving hole. When the mounting member is received in the receiving hole with the fitting relation, the filter is disposed in a fluid passage of the housing. A clearance having a dimension is formed between an outer circumferential surface of the holding portion and an inner circumferential surface of the receiving hole. Minimum value of the dimension is smaller than the overlap distance.

11 Claims, 16 Drawing Sheets

STRUCTURE FOR MOUNTING A FILTER IN A COMPRESSOR

BACKGROUND OF THE INVENTION

The present invention relates to a structure for mounting in a compressor a filter for eliminating foreign substances contained in the oil separated from refrigerant gas under a discharge pressure in the compressor.

Japanese Unexamined Patent Application Publication No. 55-29040 discloses a compressor having a filter for eliminating foreign substances contained in the oil separated from refrigerant gas under a discharge pressure. The compressor of this Publication has a cylinder head having a discharge chamber therein, an oil collection chamber and an oil reservoir. An oil separator is located between the discharge chamber and the oil collection chamber. The oil reservoir is located below the oil collection chamber and communicates therewith via a communication hole. The oil reservoir also communicates with a crank chamber of the compressor via an oil return passage having a first hole, a second hole and a third hole. A capillary is inserted in the first hole and serves as a throttle member. The capillary is provided at one end thereof adjacent to the oil reservoir with a cylindrical wire mesh filter.

In this compressor, oil contained in the refrigerant gas discharged from the discharge chamber is separated from the refrigerant gas by the oil separator. The separated oil is collected in the oil collection chamber and then flows through the communication hole to be reserved in the oil reservoir. The oil reserved in the oil reservoir flows into the oil return passage through the capillary. Because foreign substances contained in the oil then passing through the capillary are eliminated by the wire mesh filter, the capillary and the oil return passage will not be clogged with the foreign substances.

Japanese Unexamined Patent Application Publication No. 2002-276544 discloses a structure for mounting a control valve with a filter in a variable displacement compressor and a device for assembling the filter in the control valve. The filter of this Publication includes a frame member having at the joint thereof a hook and a hook holder. The hook is removable from the hook holder. The compressor has therein a mounting hole for receiving therein the control valve and the inner wall of the mounting hole is formed so as to complement the outer shape of the control valve. This inner wall has an inclined surface at the position where the filter is fitted. This inclined surface tapers toward the inner part of the mounting hole. As the control valve is being inserted into the mounting hole, the frame member of the filter is pressed radially inward by the tapered surface. Thus, the hook of the frame member of the filter is engaged with the hook holder and the frame member is snugly fitted in the tapered hole, so that the filter is received in the hole at a predetermined position for covering the high-pressure port of the control valve.

However, the former Publication No. 55-29040 does not provide a detailed description about the structure for connecting the capillary and the wire mesh filter. Judging from the drawings of this Publication, it can be thought that the capillary is merely covered with the wire mesh filter after being inserted into the first hole. Therefore, there is a fear that the wire mesh filter may be removed from the capillary due to vibration of the compressor.

According to the latter Publication No. 2002-276544, there is no fear that the filter provided in the mounting hole may be removed from the control valve. However, this filter is held to the control valve by using the tapered surface of the inner wall of the mounting hole. Therefore, high dimensional accuracy is required for the filter and the inner wall of the mounting hole.

The present invention, which has been made in light of the above problems, is directed to a structure for mounting a filter in a compressor, which prevents the filter from being removed from a mounting member for the uncomplicated structure in mounting the filter to the mounting member. In addition, the present invention is directed to a structure for mounting a filter in a compressor, which alleviates the requirement of high dimensional relative accuracy between the filter and the inner wall of the receiving hole for receiving therein an object to be mounted.

SUMMARY OF THE INVENTION

The present invention provides a structure for mounting a filter in a compressor. The structure includes a mounting member, a receiving hole, a first fitting portion, a second fitting portion, a fluid passage and a clearance. The mounting member is connected to the filter. The receiving hole is formed in a housing of the compressor for receiving therein the mounting member. The filter has a filter screen and a holding portion for holding the filter screen. The first fitting portion is formed on an inner circumferential surface of the holding portion. The second fitting portion is formed on an outer circumferential surface of the mounting member for having fitting relation with uneven surface to the first fitting portion for an overlap distance in a radial direction of the receiving hole. The fluid passage is formed in the housing. When the mounting member is received in the receiving hole with the first fitting portion and the second fitting portion having the fitting relation, the filter is disposed in the fluid passage. The clearance having a dimension is formed between an outer circumferential surface of the holding portion and an inner circumferential surface of the receiving hole. Minimum value of the dimension of the clearance is smaller than the overlap distance.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
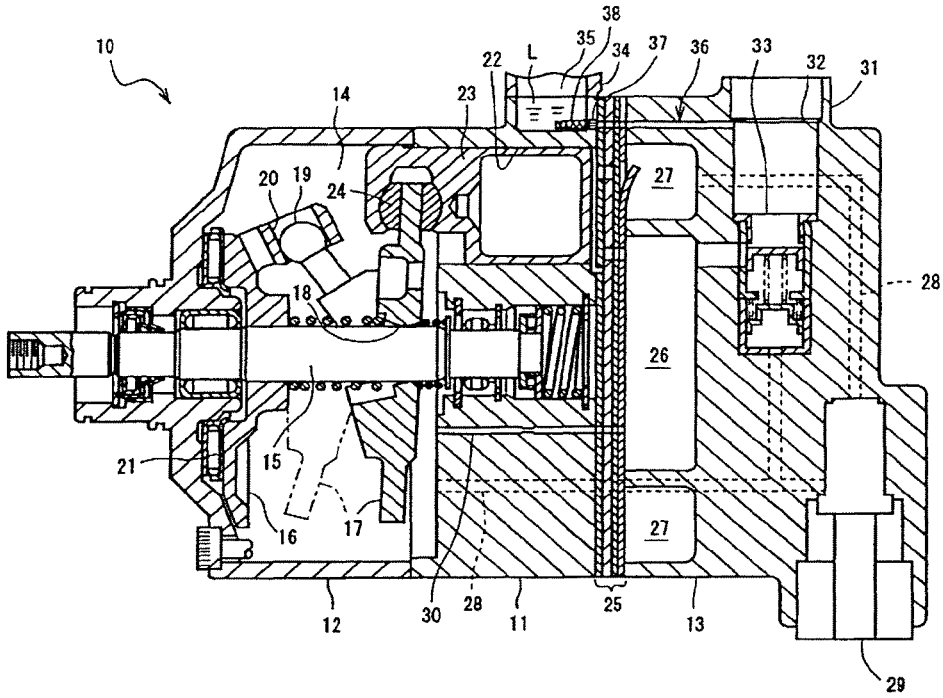
FIG. 1 is a longitudinal sectional view showing a compressor according to a first embodiment of the present invention.

The following will describe the structure for mounting an oil filter in a variable displacement type swash plate compressor according to the first embodiment of the present invention with reference to FIGS. 1 to 6. The variable displacement type swash plate compressor will be referred to as a compressor hereinafter. It is noted that the left-hand side and the right-hand side of the compressor 10 as viewed in FIG. 1 correspond to the front and rear of the compressor 10, respectively. As shown in FIG. 1, the compressor 10 includes a cylinder block 11, a front housing 12 joined to the front end of the cylinder block 11 and a rear housing 13 joined to the rear end of the cylinder block 11. The front housing 12, the cylinder block 11 and the rear housing 13 cooperate to form a housing that serves as an outer shell of the compressor 10. The cylinder block 11 and the front housing 12 define a crank chamber 14.

A rotary shaft 15 extends through the crank chamber 14 and is rotatably supported by the front housing 12 and the cylinder block 11. The front end of the rotary shaft 15 extends out of the front housing 12 and is connected to a mechanism (not shown) for receiving torque from a drive source (not shown) such as an automotive engine or motor. A lug plate 16 is fixed on the rotary shaft 15 at a position in the crank chamber 14. In addition, a swash plate 17 is provided on the rotary shaft 15 at a position in the crank chamber 14 in engagement with the lug plate 16.

The swash plate 17 has at the center thereof a hole 18 through which the rotary shaft 15 extends. A pair of guide pins 19 project from the surface of the swash plate 17 facing the lug plate 16 and is slidably held by a pair of guide holes 20 formed through the lug plate 16, respectively, so that the swash plate 17 is rotatable with the rotary shaft 15. Due to the structure wherein the guide pins 19 are slidable in the guide holes 20, the swash plate 17 is also slidable in the axial direction of the rotary shaft 15. In addition, the swash plate 17 is inclinably supported by the rotary shaft 15. A thrust bearing 21 is provided on the front inner-wall of the front housing 12, thus allowing the lug plate 16 to slide over the front housing 12.

The cylinder block 11 has therethrough a plurality of cylinder bores 22 arranged around the rotary shaft 15 and a piston 23 is slidably received in each of the cylinder bores 22. Each piston 23 receives therein a pair of shoes 24. The front end of each piston 23 is engaged with the periphery of the swash plate 17 through its corresponding pair of shoes 24. As the swash plate 17 rotates with the rotary shaft 15, each piston 23 moves back and forth in its cylinder bore 22 through its pair of shoes 24.

An oil reservoir forming member 34 is joined on the top peripheral surface of the cylinder block 11 to form an oil reservoir 35 for reserving therein oil L separated from refrigerant gas by an oil separator (not shown). The oil L is contained in the form of a mist in the refrigerant gas under a discharge pressure. The oil separator is disposed in a refrigerant passage (not shown) which connects a discharge chamber 27 and the external refrigerant circuit (not shown) of the compressor 10.

A valve plate assembly 25 is interposed between the cylinder block 11 and the rear housing 13. The valve plate assembly 25 and the rear housing 13 define therebetween a suction chamber 26 located radially inward in the rear housing 13 and also the discharge chamber 27 located radially outward so as to surround the suction chamber 26. The cylinder block 11 and the rear housing 13 have therethrough a communication passage 28 which provides fluid communication between the crank chamber 14 and the discharge chamber 27. The communication passage 28 extends passing through an electromagnetically-operated displacement control valve 29. The cylinder block 11 has therethrough a bleed passage 30 which provides fluid communication between the crank chamber 14 and the suction chamber 26.

The rear housing 13 has therein a suction port 31 which is connected to the external refrigerant circuit of the compressor 10. The suction port 31 and the suction chamber 26 communicate with each other through a suction passage 32 formed in the rear housing 13. A suction throttle valve 33 is disposed in the suction passage 32 for controlling the opening of the suction passage 32. An oil passage 36 extends through the cylinder block 11, the valve plate assembly 25 and the rear housing 13 for connecting the suction passage 32 and the oil reservoir 35. The oil passage 36 allows the oil L in the oil reservoir 35 to flow into the suction passage 32. The oil L serves as a fluid of the present invention, while the oil passage 36 serves as a fluid passage.

Figure 2:
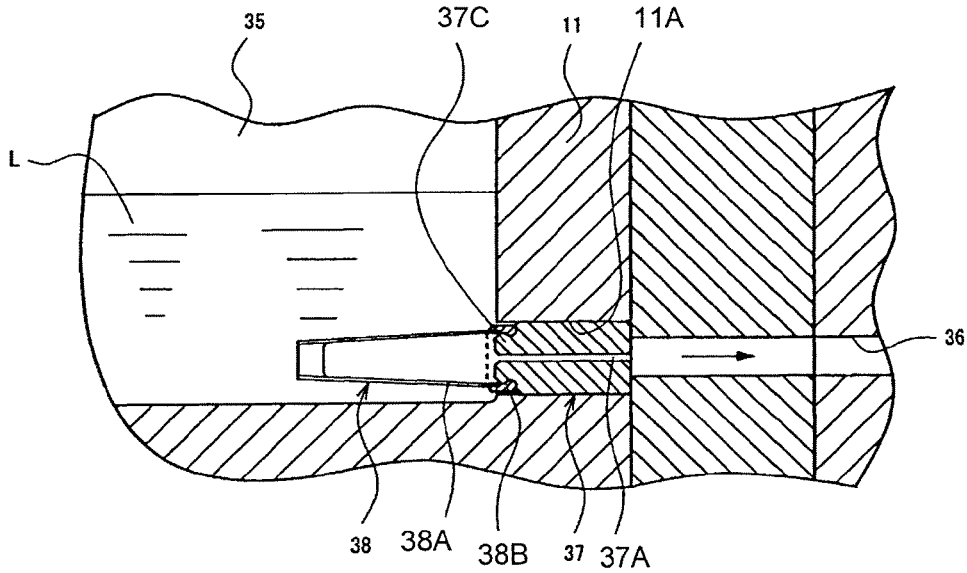
FIG. 2 is a fragmentary enlarged view showing an oil filter of the compressor of FIG. 1.
Figure 3:
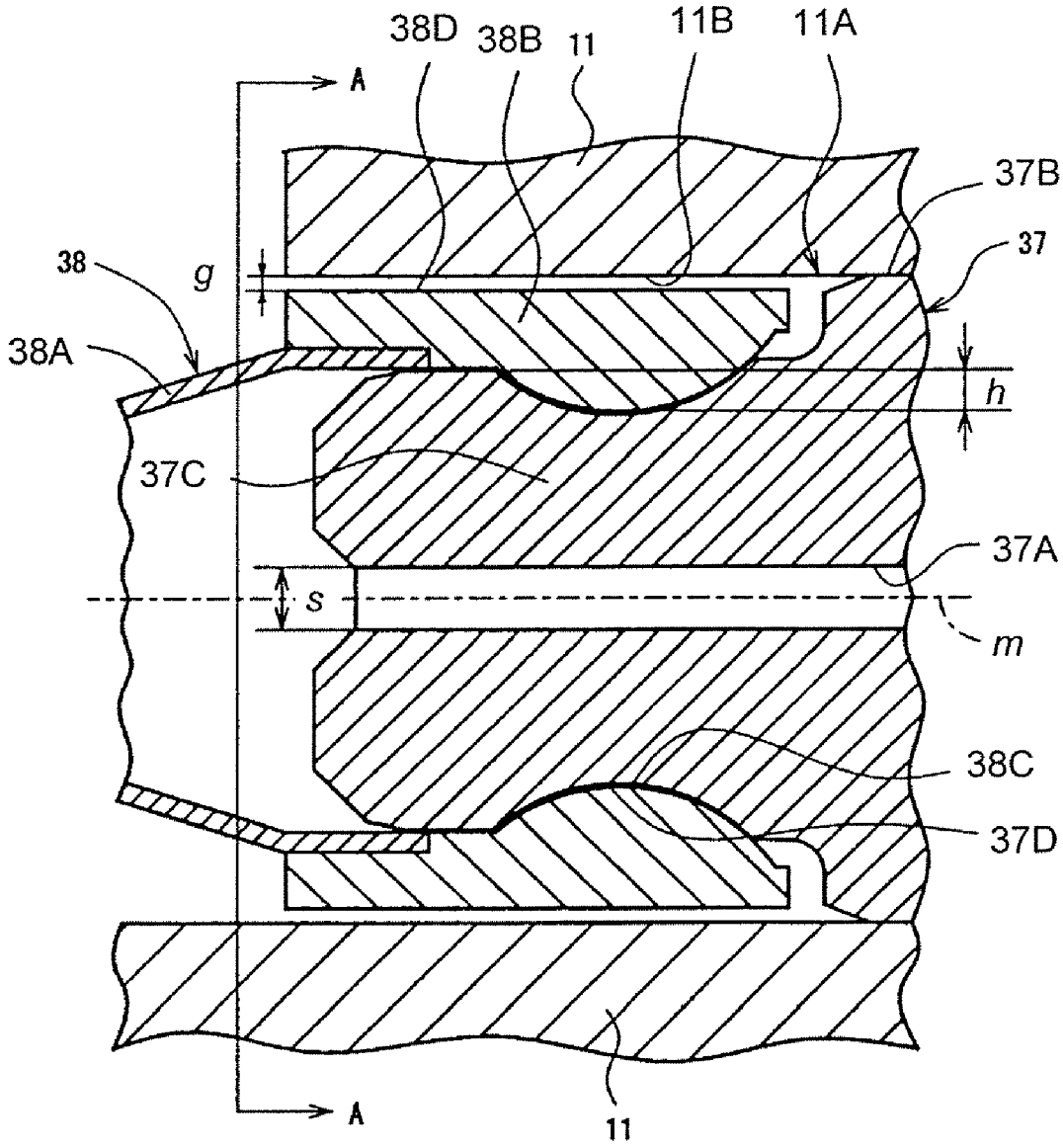
FIG. 3 is a fragmentary enlarged view showing a structure for mounting the oil filter of FIG. 2.

As shown in FIG. 2, the cylinder block 11 has therethrough a mounting hole 11A, which forms part of the oil passage 36. In the mounting hole 11A is received a throttle member 37. This throttle member 37 serves as a mounting member of the present invention and the mounting hole 11A serves as a receiving hole. The throttle member 37 is made of a resin and has a substantially cylindrical shape. As shown in FIG. 3, the throttle member 37 has an outer circumferential surface 37B which is pressed against the inner circumferential surface 11B of the mounting hole 11A in contact therewith, a connection portion 37C formed at the end of the throttle member 37 adjacent to the oil reservoir 35, and a throttle hole 37A formed axially through the throttle member 37 at the axial center thereof. The central axis of the throttle member 37 is designated by "m". An oil filter 38 is connected to the connection portion 37C of the throttle member 37. As is obvious from FIG. 3, the diameter of the connection portion 37C is smaller than that of the throttle member 37 at its outer circumferential surface 37B. The flow rate of oil L flowing from the oil reservoir 35 toward the suction passage 32 through the oil passage 36 is throttled and hence reduced by the throttle hole 37A, which helps to prevent oil shortage in the oil reservoir 35.

The oil filter 38 serves as a filter of the present invention. The oil filter 38 includes a substantially cylindrical filter screen 38A and a substantially tubular holding member 38B for holding the filter screen 38A. The holding member 38B serves as a holding portion of the present invention. The holding member 38B is connected to the connection portion 37C of the throttle member 37. The holding member 38B is made of a resilient metal. The oil filter 38 serves to separate foreign substances such as dust contained in the oil L before the oil L reserved in the oil reservoir 35 flows into the oil passage 36.

As shown in FIG. 3, the throttle member 37 is formed at the outer circumferential surface of the connection portion 37C thereof with a recess 37D. To be more specific, the recess 37D is formed such that part of the outer circumferential surface of the connection portion 37C recedes toward the central axis m of the throttle member 37 over the entire circumference. A projection 38C is formed on the inner circumferential surface of the holding member 38B of the oil filter 38. To be more specific, the projection 38C is formed such that part of the inner circumferential surface of the holding member 38B projects toward the central axis m of the throttle member 37 over the entire circumference. The projection 38C serves as a first fitting portion of the present invention and the recess 37D serves as a second fitting portion of the present invention. With the projection 38C fitted in the recess 37D, as shown in FIG. 3, the holding member 38B is connected to the connection portion 37C of the throttle member 37. After the throttle member 37 and the oil filter 38 have been connected to each other outside the mounting hole 11A, the throttle member 37 and the oil filter 38 are inserted into the mounting hole 11A to be press-fitted with the outer circumferential surface 37B of the throttle member 37 in pressing contact with the inner circumferential surface 11B of the mounting hole 11A. With the throttle member 37 thus press-fitted in the mounting hole 11A, the outer circumferential surface 38D of the holding member 38B is positioned in oppositely facing relation to the inner circumferential surface 11B of the mounting hole 11A with a clearance formed therebetween.

Figure 4:
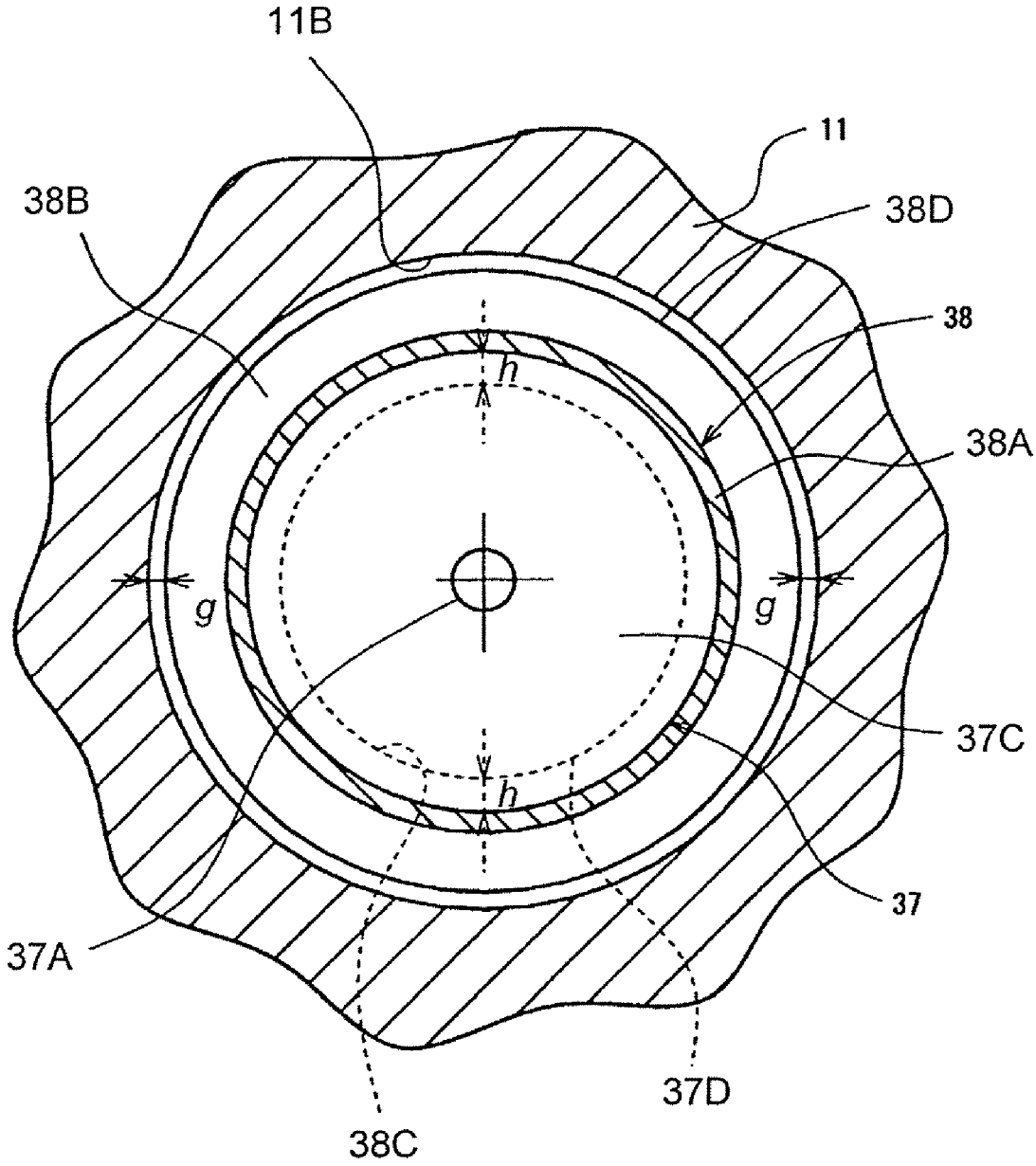
FIG. 4 is a cross sectional view of the oil filter and its related parts taken along the line A-A of FIG. 3.

When the dimension of this clearance is designated by "g", the overlap distance for which the projection 38C is fitted in the recess 37D in a radial direction of the mounting hole 11A "h", and the diameter of the throttle hole 37A "s", g is smaller than h and s, namely $g<h$ and $g<s$. As shown in FIG. 3, the dimension g of the clearance of the present embodiment is uniform over the length of the holding member 38B in the axial direction m. As shown in FIG. 4, the dimension g of the clearance and the overlap distance h are uniform over the entire circumference. Therefore, the dimension g of the clearance of the present embodiment serves as minimum value of the dimension of the clearance. Because of the fitting relation $g<h$, the holding member 38B is prevented from being removed from the connection portion 37C. Because of the relation $g<s$, the throttle hole 37A is prevented from being clogged with foreign substances which entered into the oil filter 38.

Figure 5A:
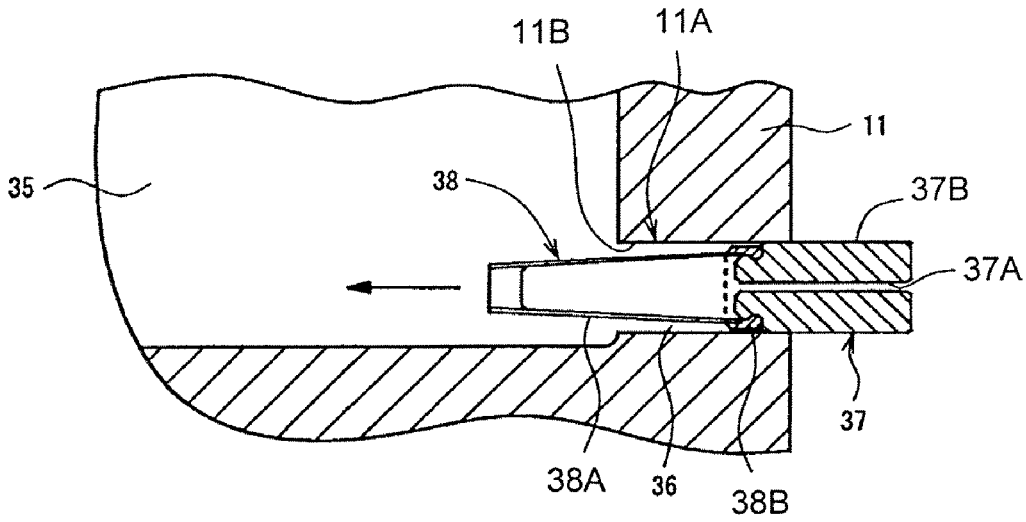
FIG. 5A is an illustrative view showing the structure for mounting the oil filter and a throttle member in the compressor, wherein the oil filter and the throttle member are inserted in the compressor from the downstream side of an oil passage formed in the compressor as viewed in the flowing direction of the oil.
Figure 5B:
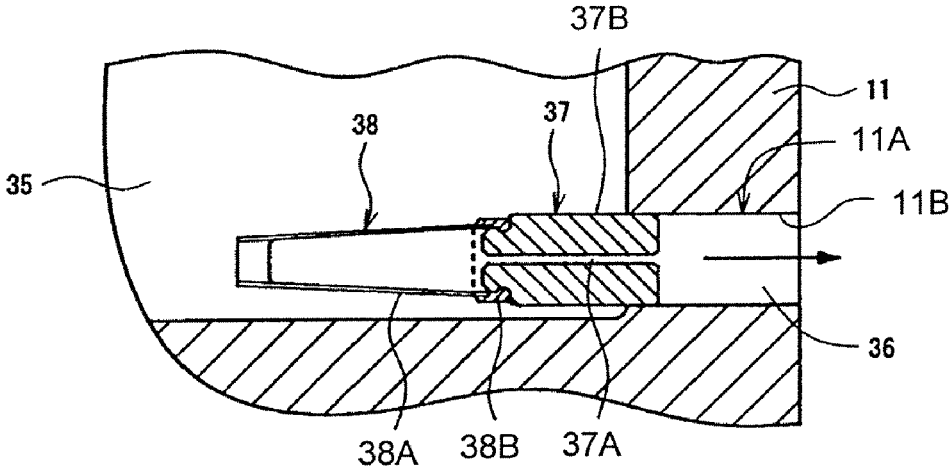
FIG. 5B is an illustrative view showing the structure for mounting the oil filter and the throttle member in the compressor, wherein the oil filter and the throttle member are inserted in the compressor from the upstream side of the oil passage of the compressor as viewed in the flowing direction of the oil.

The following will describe the method of mounting the throttle member 37 and the oil filter 38 in the compressor 10 with reference to FIGS. 5A and 5B. After the throttle member 37 and the oil filter 38 are connected or assembled to each other outside the mounting hole 11A, the throttle member 37 and the oil filter 38 are inserted into the mounting hole 11A. FIG. 5A shows one process that the throttle member 37 and the oil filter 38 assembled together are being inserted into the oil passage 36 from its downstream side, as indicated by arrow. It is noted that the side of the oil passage 36 adjacent to the oil reservoir 35 is the upstream side of the oil passage 36 and the opposite side adjacent to the suction passage 32 is the downstream side of the oil passage 36, respectively, as viewed in the direction in which oil flows through the oil passage 36. The throttle member 37 is inserted into the mounting hole 11A with the end of the filter screen 38A opposite to the holding member 38B facing forward, as shown in FIG. 5A. Pushing the throttle member 37 forward in arrow direction, the throttle member 37 is press-fitted in the mounting hole 11A with the outer circumferential surface 37B of the throttle member 37 in pressing contact with the inner circumferential surface 11B of the mounting hole 11A, as shown in FIGS. 2 and 3. At the time of installing the throttle member 37 and the oil filter 38 in the compressor 10, foreign substances may be produced due to chipping of the inner circumferential surface 11B of the mounting hole 11A. However, such foreign substances thus produced will not enter into the oil filter 38 because the throttle member 37 and the oil filter 38 are assembled together previously.

FIG. 5B shows another process that the throttle member 37 and the oil filter 38 assembled together are being inserted into the oil passage 36 from the upstream side thereof, as indicated by arrow. The throttle member 37 is inserted from the oil reservoir 35 into the mounting hole 11A with the end of the filter screen 38A opposite to the holding member 38B facing forward. Pushing the throttle member 37 rearward in arrow direction, the throttle member 37 is press-fitted in the mounting hole 11A with the outer circumferential surface 37B of the throttle member 37 in pressing contact with the inner circumferential surface 11B of the mounting hole 11A. As in the case of FIG. 5A, any foreign substances produced during the pushing will not enter into the oil filter 38.

The following will describe the operation of the compressor 10 of the present embodiment. In operation of the compressor 10 when each piston 23 reciprocates in accordance with rotary motion of the rotary shaft 15, refrigerant gas in the suction chamber 26 is introduced into its corresponding cylinder bore 22 through its suction port and suction valve (neither being shown) of the valve plate assembly 25 for compression in the cylinder bore 22 and the compressed refrigerant gas is discharged into the discharge chamber 27 under a high pressure through its discharge port and discharge valve (neither being shown) of the valve plate assembly 25. Major part of the high-pressure refrigerant gas in the discharge chamber 27 is delivered to the external refrigerant circuit (not shown) of the compressor 10.

The displacement control valve 29 is operable to determine the pressure Pc in the crank chamber 14 by controlling the relation between the amount of refrigerant gas flowing from the discharge chamber 27 into the crank chamber 14 through the communication passage 28 and the amount of refrigerant gas flowing from the crank chamber 14 into the suction chamber 26 through the bleed passage 30. As the pressure Pc in the crank chamber 14 is changed, the pressure difference between the crank chamber 14 and the cylinder bore 22 through the piston 23 is changed thereby to alter the angle of inclination of the swash plate 17. Therefore, the stroke length of the piston 23 is changed and the displacement of the compressor 10 is varied, accordingly. The suction throttle valve 33 operates in accordance with the operation of the displacement control valve 29 to throttle the flow rate of suction refrigerant gas.

Refrigerant gas discharged from the discharge chamber 27 during the operation of the compressor 10 contains misty oil. This oil is separated from the discharge-pressure refrigerant gas by the oil separator (not shown) of the compressor 10. The separated oil is delivered to the oil reservoir 35 and reserved therein, as shown in FIGS. 1 and 2. Because the pressure in the oil reservoir 35 is higher than that in the suction chamber 26, the oil L in the oil reservoir 35 is introduced through the oil passage 36 into the suction passage 32 whose pressure is lower than the pressure in the oil reservoir 35.

The throttle member 37 having the throttle hole 37A is provided at the entrance of the oil passage 36 and the oil filter 38 connected to the throttle member 37 is provided upstream of the throttle member 37. Therefore, foreign substances such as dust contained in the oil L reserved in the oil reservoir 35 is separated therefrom by the filter screen 38A of the oil filter 38 and then passed into the throttle hole 37A. The flow of oil L is restricted by the throttle hole 37A, so that oil shortage in the oil reservoir 35 due to excessive flow of oil L is prevented.

Figure 6:
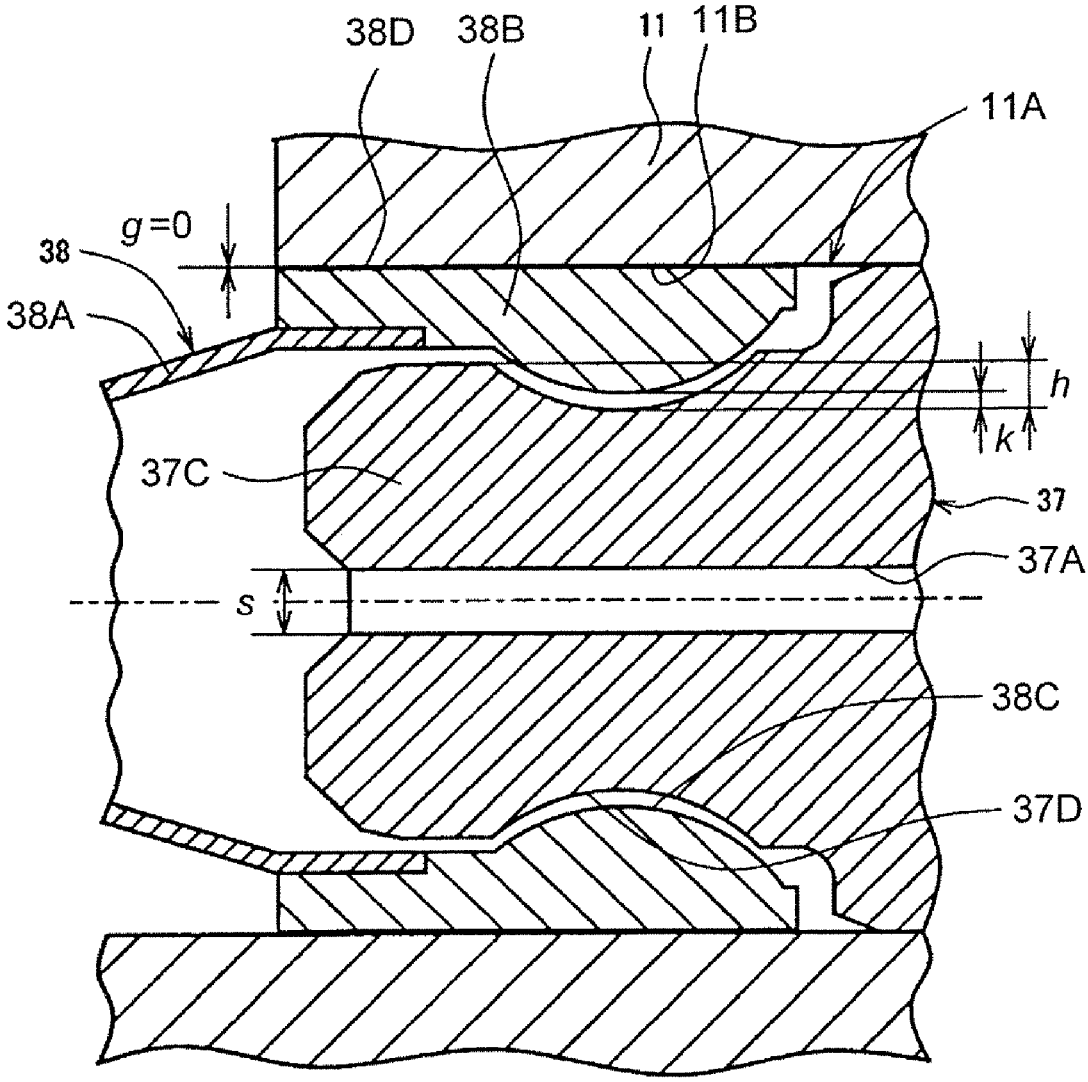
FIG. 6 is an illustrative view showing operation of the oil filter of FIG. 3.

If the holding member 38B is expanded radially outward, e.g., due to factors such as a temperature rise, the dimension g of the clearance between the outer circumferential surface 38D of the holding member 38B and the inner circumferential surface 11B of the mounting hole 11A is decreased because of the relations $g<h$ and $g<s$. When the holding member 38B is expanded fully, the outer circumferential surface 38D of the holding member 38B is brought into contact with the inner circumferential surface 11B of the mounting hole 11A, as shown in FIG. 6, so that the dimension g of the clearance becomes zero, or $g=0$. At the same time, a radial clearance with dimension k ($\approx g$) is formed between the recess 37D and the projection 38C. In virtue of the dimensional relation $g<h$, the dimension k will not exceed the dimension h, so that the fitting relation between the recess 37D and the projection 38C remains effective.

Any foreign substances contained in the oil L and entering into the oil filter 38 through the clearance will not clog the throttle hole 37A because the size of such foreign substances is smaller than the dimension g and also smaller than the diameter s of the throttle hole 37A. Thus, when the oil L reserved in the oil reservoir 35 passes through the oil filter 38 and the throttle hole 37A, foreign substances are eliminated from the oil L by the oil filter 38 and the flow of oil L is restricted by the throttle hole 37A. Oil L introduced into the suction passage 32 is supplied to the suction chamber 26 and the crank chamber 14 to lubricate various sliding parts of the compressor 10.

The structure for mounting the filter in the compressor of the first embodiment has the following advantageous effects.

(1) The recess 37D is formed on the outer circumferential surface of the connection portion 37C of the throttle member 37 and the projection 38C is formed on the inner circumferential surface of the holding member 38B of the oil filter 38. With the projection 38C fitted in the recess 37D, the oil filter 38 is held to the throttle member 37. A clearance with a uniform dimension g is formed between the outer circumferential surface 38D of the holding member 38B which is connected to the connection portion 37C and the inner circumferential surface 11B of the mounting hole 11A with which the outer circumferential surface 37B of the throttle member 37 is in pressing contact. This dimension g is set smaller than the overlap distance h for which the projection 38C is fitted in the recess 37D (i.e. $g<h$). If the holding member 38B is expanded radially outward, e.g., due to factors such as a temperature rise, the fitting relation between the recess 37D and the projection 38C remains effective, so that the oil filter 38 is prevented from being removed from the throttle member 37.

(2) Any foreign substances contained in the oil L and entering into the oil filter 38 through the clearance will not clog the throttle hole 37A because the size of such foreign substances is smaller than the dimension g and also smaller than the diameter s of the throttle hole 37A (3) After the throttle member 37 and the oil filter 38 connected together by fitting the projection 38C of the holding member 38B into the recess 37D of the throttle member 37, the throttle member 37 and the oil filter 38 are inserted and press-fitted in the mounting hole 11A with the outer circumferential surface 37B of the throttle member 37 in pressing contact with the inner circumferential surface 11B of the mounting hole 11A. Therefore, the procedure for mounting the throttle member 37 and the oil filter 38 in the compressor 10 is simplified.

(4) After the throttle member 37 and the oil filter 38 connected together by fitting the projection 38C of the holding member 38B into the recess 37D of the throttle member 37, the throttle member 37 and the oil filter 38 are inserted and press-fitted in the mounting hole 11A with the outer circumferential surface 37B of the throttle member 37 in pressing contact with the inner circumferential surface 11B of the mounting hole 11A. When the throttle member 37 and the oil filter 38 connected together are installed in the compressor 10, foreign substances may be produced due to chipping of the inner circumferential surface 11B of the mounting hole 11A. Any foreign substances which may be produced by chipping of the inner circumferential surface 11B of the mounting hole 11A during the insertion of the throttle member 37 will not enter into the oil filter 38 because the throttle member 37 and the oil filter 38 are previously connected to each other. The throttle member 37 and the oil filter 38 connected together may be inserted into the oil passage 36 from the downstream side of the oil passage 36. Alternatively, the throttle member 37 and the oil filter 38 connected together may be inserted from the upstream side of the oil passage 36.

(5) The configuration of the recess 37D on the connection portion 37C and the projection 38C on the holding member 38B for connecting the throttle member 37 to the oil filter 38 simplifies the structure of the throttle member 37 and the oil filter 38.

(6) The provision of a clearance having the dimension g between the outer circumferential surface 38D of the holding member 38B and the inner circumferential surface 11B of the mounting hole 11A facilitates the assembling and also helps to prevent the holding member 38B and the filter screen 38A from being deformed due to contact between the outer circumferential surface of the holding member 38B and the inner circumferential surface 11B of the mounting hole 11A.

Figure 7:
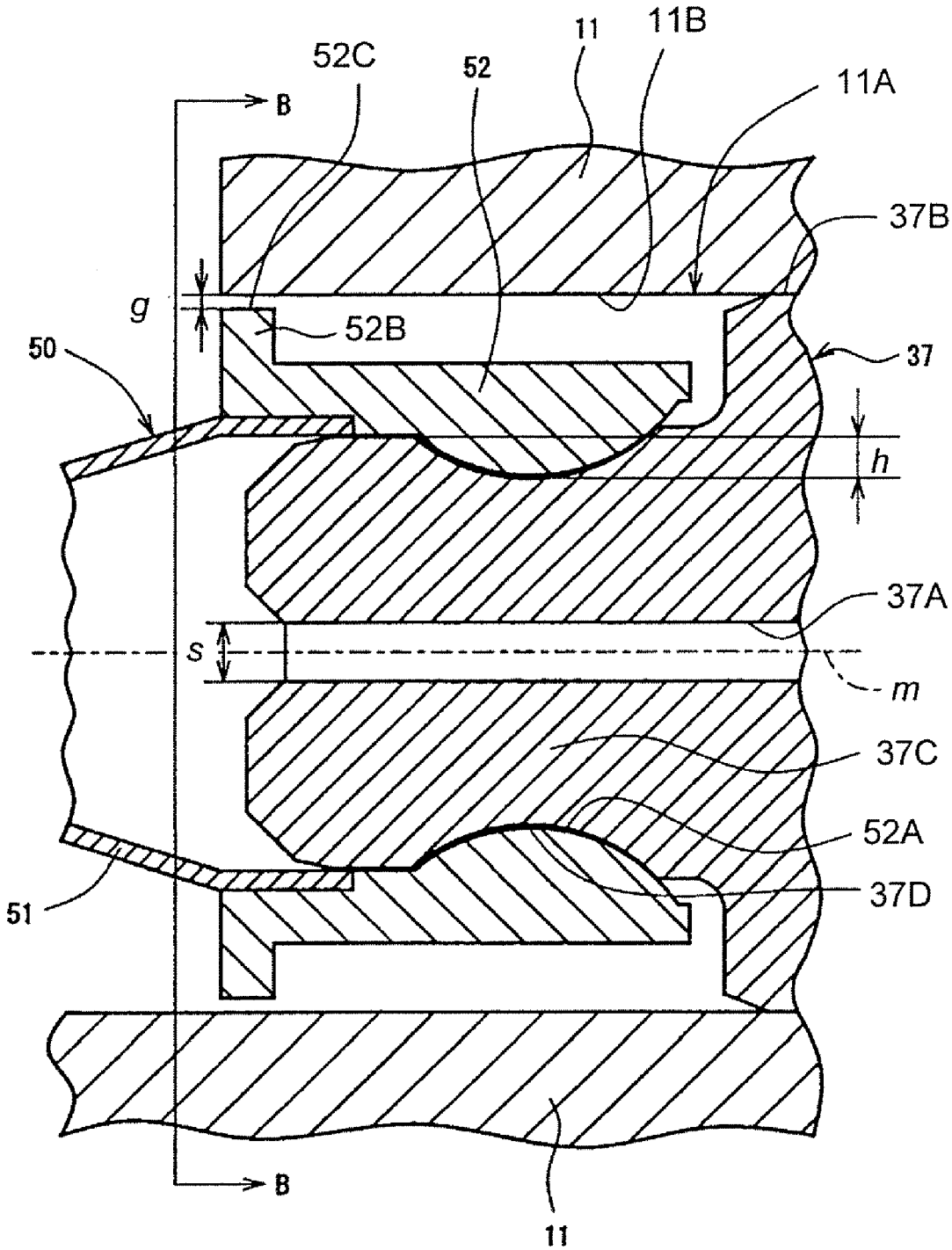
FIG. 7 is a fragmentary enlarged longitudinal sectional view showing a structure for mounting an oil filter of a compressor according to a second embodiment of the present invention.
Figure 8:
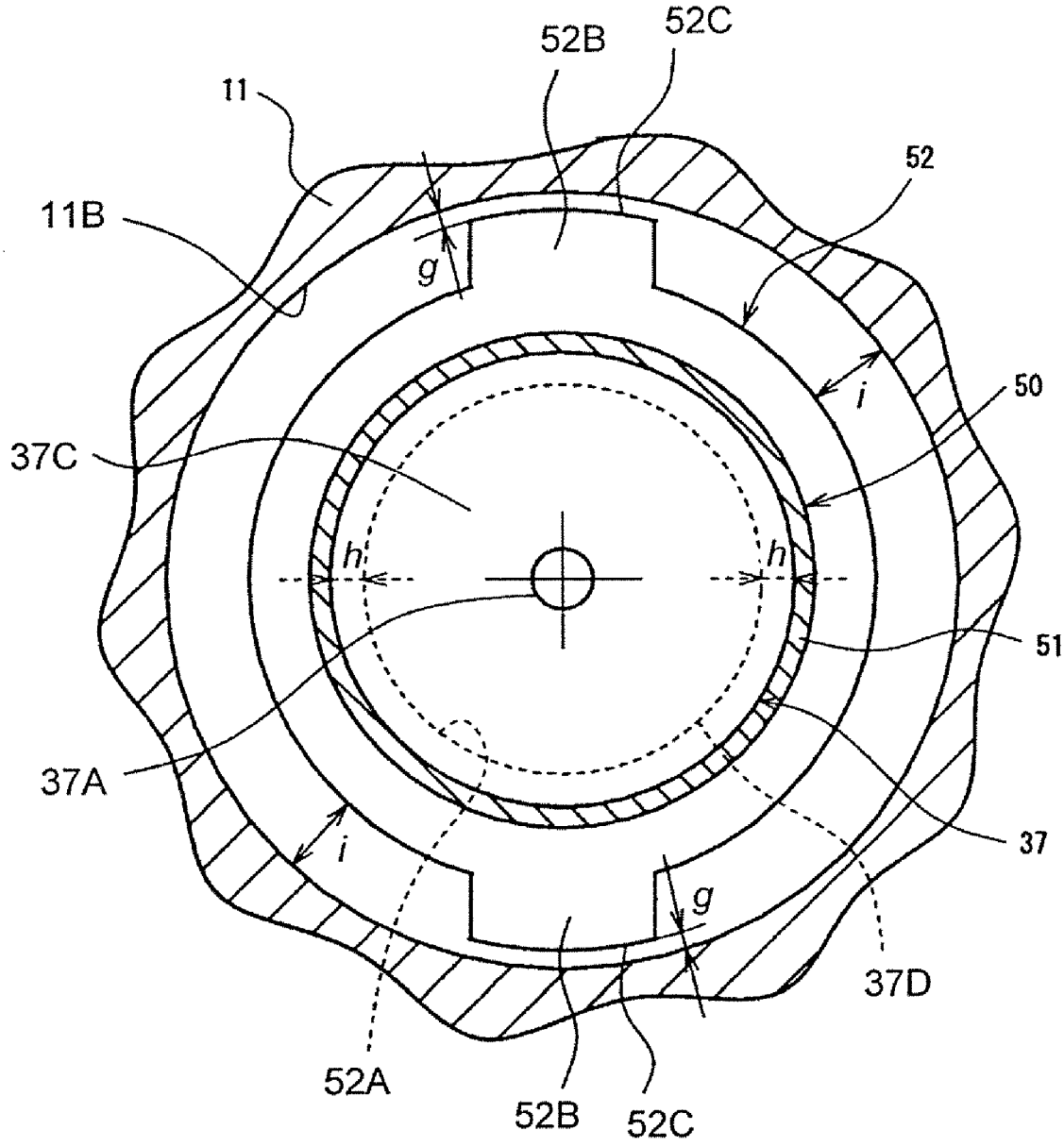
FIG. 8 is a cross sectional view of the oil filter and its related parts taken along the line B-B of FIG. 7.

The following will describe the structure for mounting an oil filter in a variable displacement type swash plate compressor according to the second embodiment of the present invention with reference to FIGS. 7 and 8. The second embodiment differs from the first embodiment in that the contour of the holding member 38B of the first embodiment is modified. The other structures of the compressor of the second embodiment are substantially the same as those of the first embodiment. For the sake of convenience of explanation, therefore, like or same parts or elements will be referred to by the same reference numerals as those which have been used in the first embodiment, and the description thereof will be omitted.

As shown in FIG. 7, an oil filter 50 that serves as a filter of the present invention has a filter screen 51 and a holding member 52 for holding the filter screen 51. The holding member 52 serves as a holding portion of the present invention. A projection 52A is formed on the inner circumferential surface of the holding member 52 and fitted in the recess 37D of the connection portion 37C of the throttle member 37. The projection 52A serves as a first fitting portion of the present invention. The holding member 52 is formed on the outer circumferential surface and at the end thereof adjacent to the oil filter 50 with a pair of protrusions 52B extending radially outward. The outer circumferential surfaces 52C of the protrusions 52B and the inner circumferential surface 11B of the mounting hole 11A are spaced away from each other with a clearance formed therebetween and having the dimension g. In the present embodiment, the dimension g of the clearance serves as minimum value of the dimension of the clearance.

As shown in FIG. 8, the protrusions 52B are disposed at an interval of 180 degrees in the circumferential direction of the holding member 52. Of the clearances between the outer circumferential surface of the holding member 52 and the inner circumferential surface 11B of the mounting hole 11A, the clearances of the dimension g between the outer circumferential surfaces 52C of the protrusions 52B and the inner circumferential surface 11B of the mounting hole 11A are the least. The dimension i of the clearances between the outer circumferential surface of the holding member 52 other than the outer circumferential surfaces 52C of the protrusions 52B and the inner circumferential surface 11B of the mounting hole 11A is larger than the dimension g. This dimension g is set smaller than the overlap distance h for which the projection 52A is fitted in the recess 37D ($g<h$). The dimension g is smaller than the diameter s of the throttle hole 37A, and the dimension i is larger than the diameter s of the throttle hole 37A.

Therefore, if the holding member 52 is expanded radially outward, e.g., due to factors such as a temperature rise, the dimension g of the clearance is decreased (not shown). When the holding member 52 is expanded fully, the outer circumferential surfaces 52C of the protrusions 52B are brought into contact with the inner circumferential surface 11B of the mounting hole 11A and hence the dimension g becomes zero, or $g=0$. At the same time, a radial clearance with a dimension that is substantially the same as the dimension g is formed between the recess 37D and the projection 52A. Because of the relation $g<h$, this dimension of the radial clearance will not exceed the overlap distance h. That is, the fitting relation between the recess 37D and the projection 52A remains effective thereby to prevent the oil filter 50 from being removed from the throttle member 37.

When installing the throttle member 37 and the oil filter 50 connected together in the mounting hole 11A, the throttle member 37 is inserted, for example, from the oil reservoir 35 into the mounting hole 11A until the throttle member 37 is press-fitted in the mounting hole 11A with the outer circumferential surface 37B of the throttle member 37 in pressing contact with the inner circumferential surface 11B of the mounting hole 11A, as shown in FIG. 7. In installing the throttle member 37, the throttle member 37 may be pushed rearward at the protrusions 52B with a tool. The holding member 52 and the connection portion 37C may be connected together easily by holding the protrusions 52B by any suitable tool when fitting the projection 52A into the recess 37D. Therefore, installation of the throttle member 37 and the oil filter 50 to the mounting hole 11A can be performed with improved efficiency. The other features of the second embodiment are substantially the same as those of the first embodiment and, therefore, the description thereof will be omitted.

The structure for mounting the filter in the compressor of the second embodiment has substantially the same effects as (1) and (3)-(6) of the first embodiment. In addition, the following advantageous effect is obtained.

(7) The holding member 52 and the connection portion 37C may be connected together easily by holding the protrusions 52B by any suitable tool when fitting the projection 52A into the recess 37D. Therefore, installation of the throttle member 37 and the oil filter 50 to the mounting hole 11A can be performed with improved efficiency.

Figure 9:
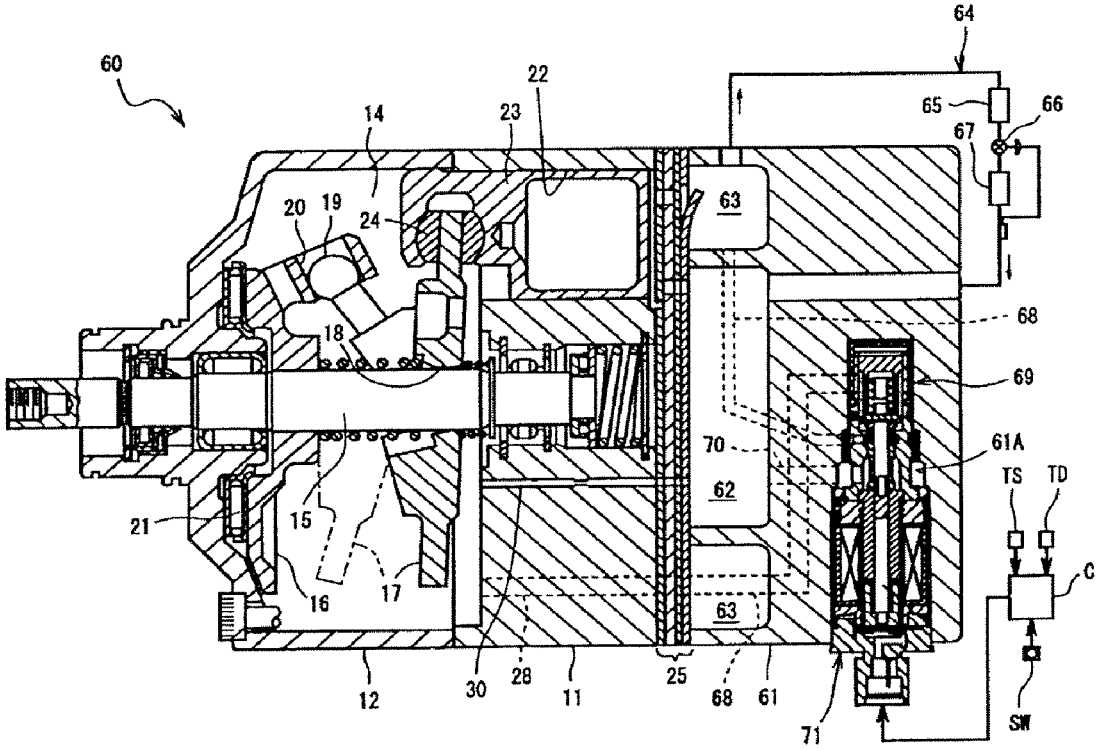
FIG. 9 is a longitudinal sectional view showing a compressor according to a third embodiment of the present invention.
Figure 10:
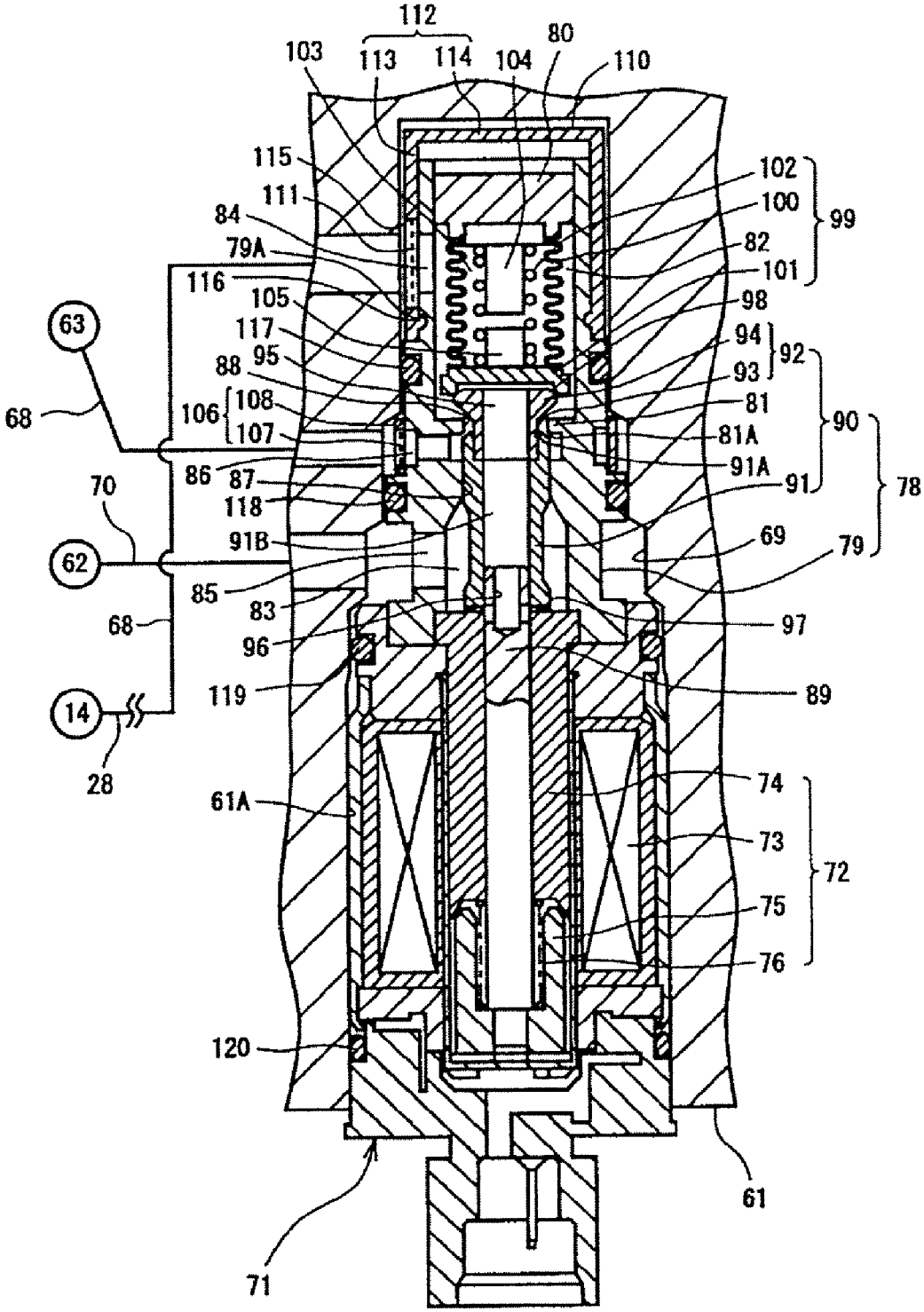
FIG. 10 is a fragmentary enlarged longitudinal sectional view showing a structure for mounting a filter of the compressor of the third embodiment.
Figure 11:
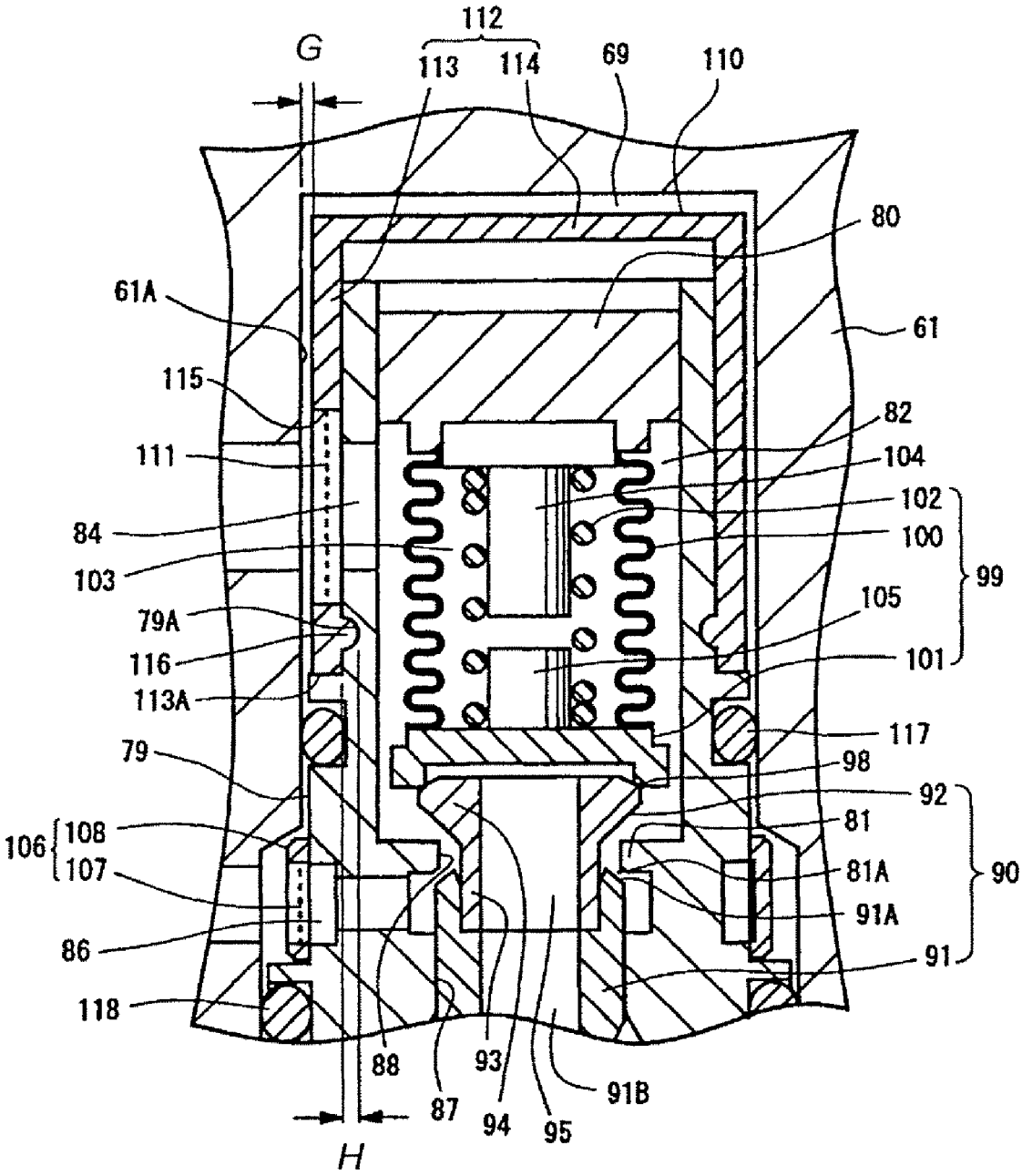
FIG. 11 is a fragmentary enlarged view showing the structure for mounting the filter of FIG. 10.

The following will describe the structure for mounting a filter in a variable displacement type swash plate compressor according to the third embodiment of the present invention with reference to FIGS. 9 to 11. The third embodiment will be described in the case wherein a filter is mounted to the displacement control valve 29 of the first embodiment. In addition, the rear housing 13 of the first embodiment is modified and the oil reservoir 35 of the first embodiment is eliminated. Therefore, the compressor 10 of the first embodiment of FIG. 1 differs from the compressor 60 of the third embodiment of FIG. 9 in that the front housing 12 dispenses with the oil reservoir 35 and the rear housing 61 is modified from the counterpart of the first embodiment. The other structures of the compressor 60 of the third embodiment are substantially the same as those of the first embodiment. For the sake of convenience of explanation, therefore, like or same parts or elements will be referred to by the same reference numerals as those which have been used in the first embodiment, and the description thereof will be omitted.

Referring to FIG. 9, the rear housing of the compressor 60 is designated by numeral 61. The valve plate assembly 25 and the rear housing 61 define therebetween a suction chamber 62 located radially inward in the rear housing 61 and a discharge chamber 63 located radially outward so as to surround the suction chamber 62. The suction chamber 62 and the discharge chamber 63 are connected to an external refrigerant circuit 64 of the compressor 60. The external refrigerant circuit 64 includes a condenser 65 which absorbs heat from the refrigerant gas, an expansion valve 66 and an evaporator 67 which transfers ambient heat to refrigerant gas. The expansion valve 66 is operable to sense the temperature of the refrigerant gas at the outlet of the evaporator 67 and to control the flow of refrigerant gas according to the variation in temperature. High-pressure refrigerant gas discharged to the discharge chamber 63 is delivered to the external refrigerant circuit 64. Low-pressure refrigerant gas is introduced into the suction chamber 62 through the external refrigerant circuit 64. The region in the external refrigerant circuit 64 downstream of the evaporator 67 and up to the suction chamber 62 of the compressor 60 serves as a suction pressure region of the present invention. Refrigerant gas in the suction pressure region is under a suction pressure or a pressure close to the suction pressure.

The communication passage 28 is formed in the cylinder block 11 and a communication passage 68 is formed in the rear housing 61. The crank chamber 14 and the discharge chamber 63 are in communication via the communication passages 28 and 68. The communication passages 28 and 68 provide a supply passage through which refrigerant gas under a discharge pressure flows. The communication passages 28 and 68 serve as a refrigerant passage which allows refrigerant gas to flow and also serve as a fluid passage of the present invention. The rear housing 61 has therein a valve receiving hole 69 at its upper end closed and adapted to receive therein a displacement control valve 71, which serves as a mounting member of the present invention. The valve receiving hole 69 is formed by boring the rear housing 61 radially from the outer circumferential surface thereof. The valve receiving hole 69 communicates with the communication passage 68 and the displacement control valve 71 fitted in the valve receiving hole 69 is disposed in the middle of the communication passage 68. The valve receiving hole 69 is formed so as to complement the outer shape of the displacement control valve 71 and designed to receive therein the displacement control valve 71. Referring to FIG. 10, the valve receiving hole 69 has an inner circumferential surface 61A. The inner circumferential surface 61A is formed with a plurality of stepped portions so that the diameter of the valve receiving hole 69 decreases progressively from the opened bottom toward the closed inner upper end of the valve receiving hole 69.

The displacement control valve 71 is externally controlled and its main parts includes an electromagnetic solenoid 72 and a control valve body 78. The electromagnetic solenoid 72 includes a coil 73, a stator core 74, a movable core 75 and a spring 76. The electromagnetic solenoid 72 is excited by application of electric current to the coil 73. The stator core 74 extends through the coil 73. The movable core 75 is located below the stator core 74 and movable reciprocally toward and away from the stator core 74 for a predetermined distance. The spring 76 is provided between the stator core 74 and the movable core 75 for urging the movable core 75 away from the stator core 74. The stator core 74 attracts the movable core 75 by excitation of the electromagnetic solenoid 72. When the electromagnetic solenoid 72 is deenergized, the movable core 75 is moved away from the stator core 74 by the urging force of the spring 76.

As shown in FIG. 9, the displacement control valve 71 is connected to a controller C controlling the amount of electric current to be supplied to the electromagnetic solenoid 72 (i.e. duty cycle control). Air conditioner switch SW is connected to the controller C. With the switch SW turned on, the controller C operates to supply electric current to the electromagnetic solenoid 72. When the switch SW is turned off, the controller C stops supplying electric current to the electromagnetic solenoid 72. A room temperature setting device TS and a room temperature detector TD are connected to the controller C. With the switch SW turned on, the controller C operates to control the amount of electric current supplied to the electromagnetic solenoid 72 based on the difference between the target room temperature set by the room temperature setting device TS and the actual room temperature detected by the room temperature detector TD.

The control valve body 78 includes a tubular valve case 79. As shown in FIG. 11, a cover 80 is fitted in the upper end of the valve case 79 and the electromagnetic solenoid 72 is connected to the lower end of the valve case 79. The space inside the valve case 79 is divided into a pressure sensitive chamber 82 and a valve chamber 83 by the partition 81 formed as a part of the valve case 79. The pressure sensitive chamber 82 is located in the upper part of the valve case 79 and the valve chamber 83 in the lower part of the valve case 79. The valve case 79 is formed therethrough adjacent to the pressure sensitive chamber 82 with an upper port 84 in facing relation to the refrigerant passage, and the pressure sensitive chamber 82 communicates with the crank chamber 14 through the upper port 84, the communication passage 68 and the communication passage 28. The valve chamber 83 communicates with the suction chamber 62 through a middle port 85 formed in the valve case 79 and a passage 70.

Referring to FIG. 11, an insertion hole 87 is formed in the valve case 79 at a position adjacent to the valve chamber 83. A valve hole 88 is formed through the partition 81 with a diameter smaller than that of the insertion hole 87. The valve case 79 has between the insertion hole 87 and the valve hole 88 a space which communicates with the discharge chamber 63 through a lower port 86 formed in the valve case 79 and the communication passage 68.

A rod 89 is fixed to the movable core 75 and extends therefrom upward. The upper end of the rod 89 is located in the valve chamber 83. A valve assembly 90 is connected to the upper end of the rod 89. The valve assembly 90 includes a main valve member 91 connected to the upper end of the rod 89 and an auxiliary valve member 92 connected to the upper end of the main valve member 91. The main valve member 91 is slidably inserted in the insertion hole 87 so as to keep the insertion hole 87 closed. The main valve member 91 has at the upper end thereof a tapered valve portion 91A. The valve portion 91A is contactable with a valve seat 81A formed on the lower end of the partition 81 by the upward movement of the rod 89. When the valve portion 91A is not in contact with the valve seat 81A, the valve hole 88 is open to the space between the valve hole 88 and the insertion hole 87, so that the pressure sensitive chamber 82 communicates with the lower port 86. When the valve portion 91A is in contact with the valve seat 81A, on the other hand, the valve hole 88 is closed by the valve portion 91A to shut off the communication between the pressure sensitive chamber 82 and the lower port 86. Thus, when the pressure sensitive chamber 82 communicates with the lower port 86, refrigerant gas in the discharge chamber 63 is introduced into the crank chamber 14 through the communication passage 68, the space inside the displacement control valve 71 and the communication passage 28. The main valve member 91 has at the axial center thereof an internal passage 91B extending in the axial direction of the rod 89. The upper end of the rod 89 is inserted in the lower end of the internal passage 91B.

The auxiliary valve member 92 includes a tubular portion 93 fitted in the upper end of the internal passage 91B of the main valve member 91 and a flange portion 94 whose outside diameter is larger than that of the tubular portion 93. The auxiliary valve member 92 has at the axial center thereof an internal passage 95 in communication with the internal passage 91B. The internal passage 95 of the auxiliary valve member 92 is allowed to communicate with the pressure sensitive chamber 82. The rod 89 has at the upper end thereof a hole 96 with its lower end closed, which communicates with the internal passage 95. The rod 89 has therethrough at the upper end thereof a communication passage 97 through which the hole 96 and the valve chamber 83 communicate with each other. Therefore, the communication passage 97, the hole 96, the internal passage 91B and the internal passage 95 cooperate to form a passage through which the valve chamber 83 and the pressure sensitive chamber 82 communicate with each other. The flange portion 94 is formed at the upper end thereof a valve body 98 which is contactable with a pressure sensitive mechanism 99 arranged in the pressure sensitive chamber 82. The valve body 98 serves to adjust the opening between the internal passage 95 and the pressure sensitive chamber 82.

The pressure sensitive mechanism 99 includes a bellows 100, a plate-like movable pressure sensitive member 101 connected to the bellows 100, and a spring 102 urging the pressure sensitive member 101 toward the auxiliary valve member 92. The upper end of the bellows 100 is fixed to the cover 80 and the lower end of the bellows 100 is fixed to the movable pressure sensitive member 101. The spring 102 is located in the bellows 100 between the cover 80 and the pressure sensitive member 101. The bellows 100 has therein a bellows chamber 103 which is placed under a vacuum. A stop 104 is provided on the lower end of the cover 80 and a stop 105 on the upper end of the pressure sensitive member 101. The upper end of the movable stop 105 is contactable with the lower end of the stop 104. The bellows 100 is contracted to its minimal length when the stop 104 is in contact with the stop 105. The above-described displacement control valve 71 controls the flow of refrigerant gas flowing through the supply passage by operating the valve assembly 90 based on the pressure of refrigerant gas in the suction pressure region and the electromagnetic force controlled by an external signal. The valve assembly 90 serves as a valve body of the present invention.

The lower port 86 in communication with the discharge chamber 63 is provided with a filter 106 for eliminating foreign substances such as dust from refrigerant gas. The filter 106 has a substantially tubular shape and covers the lower port 86 at the outer circumferential surface of the valve case 79, as shown in FIG. 11. The filter 106 has a filter screen 107 facing the lower port 86 and a holding member 108 for holding the filter screen 107. The holding member 108 serves as a holding portion of the present invention. The holding member 108 is provided with an engaging portion (not shown) for removably mounting the filter 106 to the valve case 79. The filter 106 serves to eliminate foreign substances such as dust from the refrigerant gas introduced from the discharge chamber 63 to the space inside the displacement control valve 71. This filter 106 prevents the displacement control valve 71 from failing to operate properly due to the presence of foreign substances in the refrigerant gas.

The upper port 84 in communication with the crank chamber 14 is provided with a filter 110 for eliminating foreign substances such as dust from the refrigerant gas returning from the crank chamber 14 to the space inside the displacement control valve 71. The filter 110 is in the form of a tube with its upper end closed and connected to the upper end of the displacement control valve 71. The filter 110 includes a filter screen 111 for covering the upper port 84 and a holding member 112 for holding the filter screen 111. The holding member 112 serves as a holding portion of the present invention. The holding member 112 is made of a resilient resin. The holding member 112 includes a cylindrical side portion 113 and a circular top portion 114 for covering the upper end of the side portion 113. The lower end of the side portion 113 is opened and the end will be referred to as an open end 113A of the side portion 113. An opening 115 is formed through the side portion 113 at the position corresponding to the upper port 84 and the aforementioned filter screen 111 is disposed in the opening 115. A projection 116 is formed on the inner circumferential surface of the side portion 113 over its entire circumference at a position between the opening 115 and the open end 113A so as to project radially inward. On the other hand, a recess 79A is formed in the outer circumferential surface of the valve case 79 over its entire circumference at a position lower than and adjacent to the upper port 84 so as to recede radially inward. As shown in FIG. 11, the projection 116 and the recess 79A have complementary arcuate shapes as viewed in the longitudinal section of the filter 110. These arcuate projection 116 and recess 79A facilitate removable connection of the filter 110 and the valve case 79.

The projection 116 of the filter 110 is fitted in the recess 79A of the valve case 79. The projection 116 and the recess 79A serve as a first fitting portion and a second fitting portion of the present invention, respectively. With the projection 116 fitted in the recess 79A, the filter 110 is held by the valve case 79. As shown in FIG. 11, the projection 116 is fitted in the recess 79A for the overlap distance H. By moving the projection 116 away from the recess 79A radially outward of the valve receiving hole 69 for the overlap distance H, the filter 110 becomes removable from the valve case 79. In installing the filter 110 on the valve case 79, the filter 110 is mounted onto the valve case 79 from its small diameter side and pushed toward the opposite large diameter side of the valve case 79. Before the projection 116 reaches the recess 79A, the open end 113A of the holding member 112 is enlarged radially outward for the overlap distance H. Pushing the filter 110 further on the valve case 79 until the projection 116 reaches the recess 79A, the projection 116 is fitted in the recess 79A thereby to connect the filter 110 to the valve case 79.

With the displacement control valve 71 received in place in the valve receiving hole 69, a clearance having a dimension G is formed between the outer circumferential surface of the side portion 113 of the filter 110 and the inner circumferential surface 61A of the valve receiving hole 69. The dimension G of the clearance of the present embodiment is substantially uniform over the axial length of the side portion 113 of the filter 110. In the present embodiment, the dimension G is smaller than the overlap distance H, or $G<H$. Therefore, with the displacement control valve 71 received in the valve receiving hole 69, the filter 110 is prevented from being removed from the valve case 79.

O-rings 117, 118, 119, 120 are provided in the outer circumferential surface of the displacement control valve 71 and each of the O-rings 117-120 serves as a sealing member. The O-ring 117 is located between the upper port 84 and the lower port 86 to create a seal between the outer circumferential surface of the displacement control valve 71 and the inner circumferential surface 61A of the valve receiving hole 69. Thus, flow of refrigerant gases between the upper port 84 and the lower port 86 is shut off. The O-ring 118 is located between the lower port 86 and the middle port 85 to create a seal between the outer circumferential surface of the displacement control valve 71 and the inner circumferential surface 61A of the valve receiving hole 69. Thus, flow of refrigerant gas between the lower port 86 and the middle port 85 is shut off. The O-rings 119, 120 prevent refrigerant gas in the valve receiving hole 69 from leaking out therefrom.

The following will describe the operation of the compressor 60 of the present embodiment. When the compressor 60 operates at its maximum displacement, electric current is supplied to the coil 73 to excite the electromagnetic solenoid 72 of the displacement control valve 71. The application of electric current to the coil 73 causes the movable core 75 to move toward the stator core 74, so that the rod 89 is moved in the direction that causes the valve hole 88 to be closed. When the valve hole 88 is closed by the valve portion 91A, refrigerant gas in the discharge chamber 63 remains there without flowing into the crank chamber 14. When the compressor 60 operates at a displacement other than the maximum displacement, the rod 89 is located to open the valve hole 88. With the valve hole 88 thus opened, refrigerant gas in the discharge chamber 63 flows into the crank chamber 14 through the communication passage 68, the lower port 86, the valve hole 88, the pressure sensitive chamber 82 and the upper port 84. When the refrigerant gas passes through the lower port 86, the filter screen 107 at the lower port 86 filters the refrigerant gas thereby to separate therefrom foreign substances such as dust. Thus, the foreign substances such as dust will not enter into the valve case 79.

When the operation of the compressor 60 is stopped for a long time, liquid refrigerant may be reserved in the crank chamber 14. When the operation of the compressor 60 is started after the long shutdown of the compressor 60, the liquid refrigerant in the crank chamber 14 may flow into the pressure sensitive chamber 82 through the communication passages 28, 68 and the upper port 84. In this case, the foreign substances such as dust is prevented from entering into the valve case 79 because such foreign substances are separated from the liquid refrigerant by the filter 110. Thus, the foreign substances contained in the refrigerant gas or liquid refrigerant are removed by the filter 110.

If the holding member 112 is expanded radially outward, e.g., due to factors such as a temperature rise, the dimension G of the clearance between the outer circumferential surface of the side portion 113 of the filter 110 and the inner circumferential surface 61A of the valve receiving hole 69 decreases because of the relation G<H. When the holding member 112 is expanded fully, the outer circumferential surface of the holding member 112 is brought into contact with the inner circumferential surface 61A of the valve receiving hole 69 and the dimension G of the clearance becomes zero, or G=0. At the same time, a radial clearance with a dimension that is substantially the same as the dimension G is formed between the recess 79A and the projection 116. Because of the dimensional relation G<H, the dimension of the above radial clearance will not exceed the overlap distance H. That is, the filter 110 is prevented from being removed from the valve case 79.

The structure for mounting the filter in the compressor of the third embodiment has the following advantageous effects.

(8) The recess 79A is formed on the outer circumferential surface of the valve case 79 and the projection 116 is formed on the inner circumferential surface of the side portion 113 of the filter 110. When the projection 116 is fitted into the recess 79A, the filter 110 is connected to the valve case 79. The clearance with a uniform dimension G is formed between the outer circumferential surface of the holding member 112 and the inner circumferential surface 61A of the valve receiving hole 69. This dimension G is set smaller than the overlap distance H for which the projection 116 is fitted in the recess 79A (i.e. G<M. When the holding member 112 of the filter 110 is expanded radially outward, e.g. due to factors such as a thermal expansion, the fitting relation between the recess 79A and the projection 116 remains effective thereby to prevent the filter 110 from being removed from the valve case 79.

(9) After the filter 110 and the valve case 79 are connected together by fitting the projection 116 into the recess 79A, the filter 110 and the displacement control valve 71 are inserted together into the valve receiving hole 69 to be fixed to the rear housing 61. Thus, the procedure of mounting the filter 110 and the displacement control valve 71 in the rear housing 61 is greatly simplified.

Figure 12:
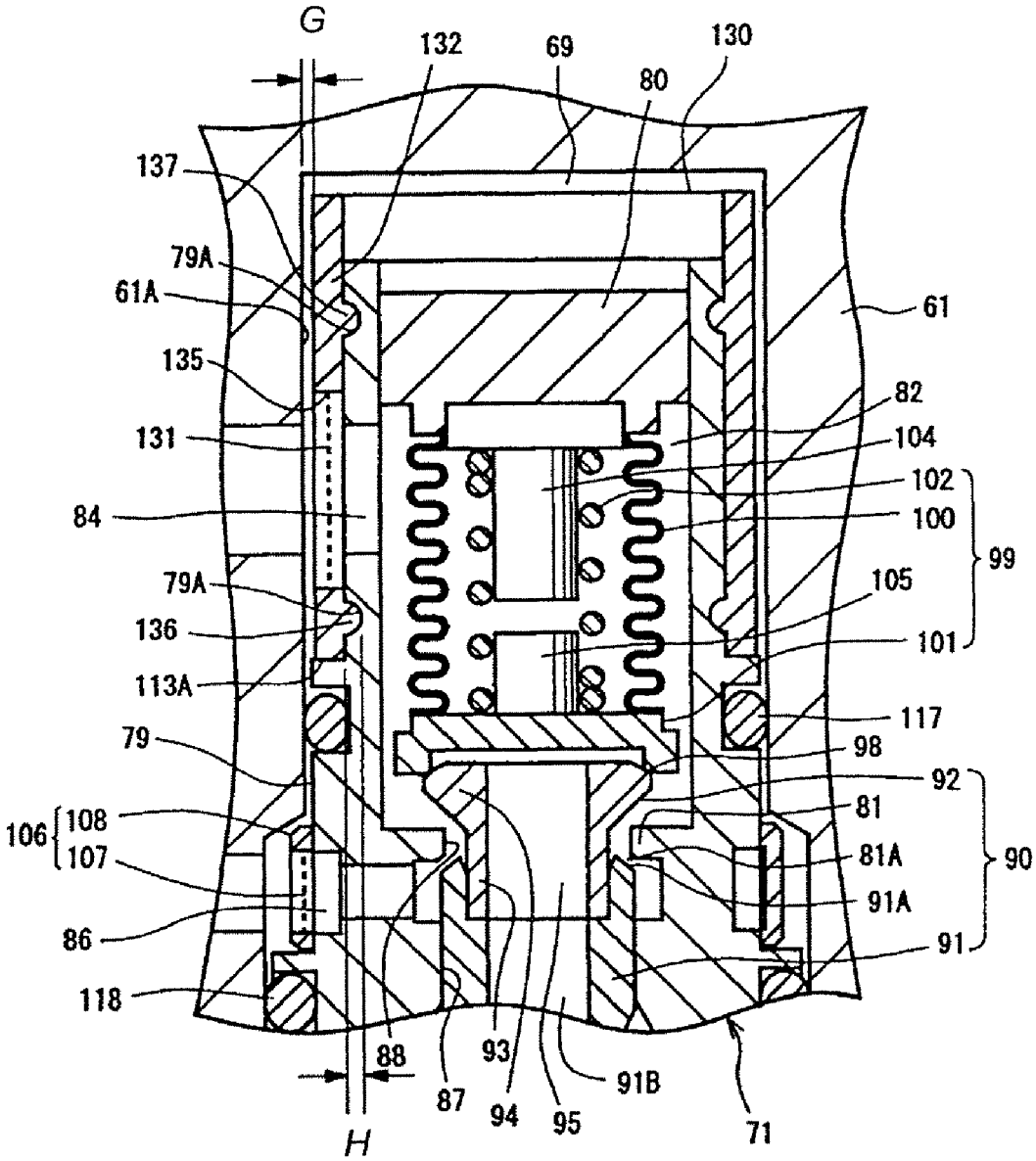
FIG. 12 is a view similar to FIG. 11, but showing a structure for mounting a filter of a compressor according to a fourth embodiment of the present invention.

The following will describe the structure for mounting a filter in a variable displacement type swash plate compressor according to the fourth embodiment of the present invention with reference to FIG. 12. The fourth differs from the third embodiment in that the shapes of the filter 110 and the valve case 79 of the third embodiment are modified. The other structures of the compressor of the fourth embodiment are substantially the same as those of the third embodiment. For the sake of convenience of explanation, therefore, like or same parts or elements will be referred to by the same reference numerals as those which have been used in the third embodiment, and the description thereof will be omitted.

As shown in FIG. 12, the displacement control valve 71 has a filter 130. The filter 130 includes a filter screen 131 covering the upper port 84 and a holding member 132 for holding the filter screen 131. The holding member 132 serves as a holding portion of the present invention. This holding member 132 includes a tubular side portion with both opposite ends thereof opened. The filter screen 131 of the fourth embodiment has substantially the same structure as the counterpart filter screen 111 of the third embodiment. The holding member 132 is formed through the side portion thereof with an opening 135 and on the inner circumferential surface thereof with two projections 136, 137. The opening 135 and the projection 136 of the fourth embodiment have substantially the same structure as the opening 115 and the projection 116 of the third embodiment. The additional projection 137 is similar to the projection 136, but the former projection is located between the upper end of the holding member 132 and the opening 135. Two recesses 79A are formed on the outer circumferential surface of the valve case 79 so as to correspond to the projections 136, 137.

The projection 136 is fitted in the lower recess 79A of the valve case 79 and the projection 137 is also fitted in the upper recess 79A of the valve case 79. Each of the projections 136, 137 serves as a first fitting portion of the present invention and each of the upper and lower recesses 79A serves as a second fitting portion of the present invention. With the projections 136, 137 fitted in the respective recesses 79A, the filter 130 is held by the valve case 79. As shown in FIG. 12, the projections 136, 137 are fitted in the recesses 79A for the overlap distance H, respectively. When the projections 136, 137 are moved from the recesses 79A radially outward of the valve receiving hole 69 for the overlap distance H, the filter 130 becomes removable from the valve case 79.

With the displacement control valve 71 received in place in the valve receiving hole 69, a clearance having a dimension G is formed between the outer circumferential surface of the holding member 132 of the filter 130 and the inner circumferential surface 61A of the valve receiving hole 69. The dimension G of the clearance of the present embodiment is uniform over the axial length of the holding member 132 of the filter 130. In the present embodiment, the dimension G is smaller than the overlap distance H, or G<H. Therefore, when the displacement control valve 71 is received in the valve receiving hole 69, the filter 130 is prevented from being removed from the valve case 79.

The structure for mounting the filter in the compressor of the fourth embodiment has substantially the same effects as (8) and (9) of the third embodiment. In addition, the following advantageous effects are obtained.

(10) The filter 130 is formed with two projections 136, 137 and the valve case 79 is formed with two recesses 79A corresponding to the projections 136, 137. Therefore, the filter 130 of the present embodiment is more difficult to be removed from the valve case 79 than the filter 110 of the third embodiment.

(11) The holding member 132 of the filter 130 is in the form of a tube with its opposite ends opened. Compared to the case wherein the holding member has a circular top portion, the material used for the holding member is reduced and the weight of the filter 130 is also reduced, accordingly.

Figure 13:
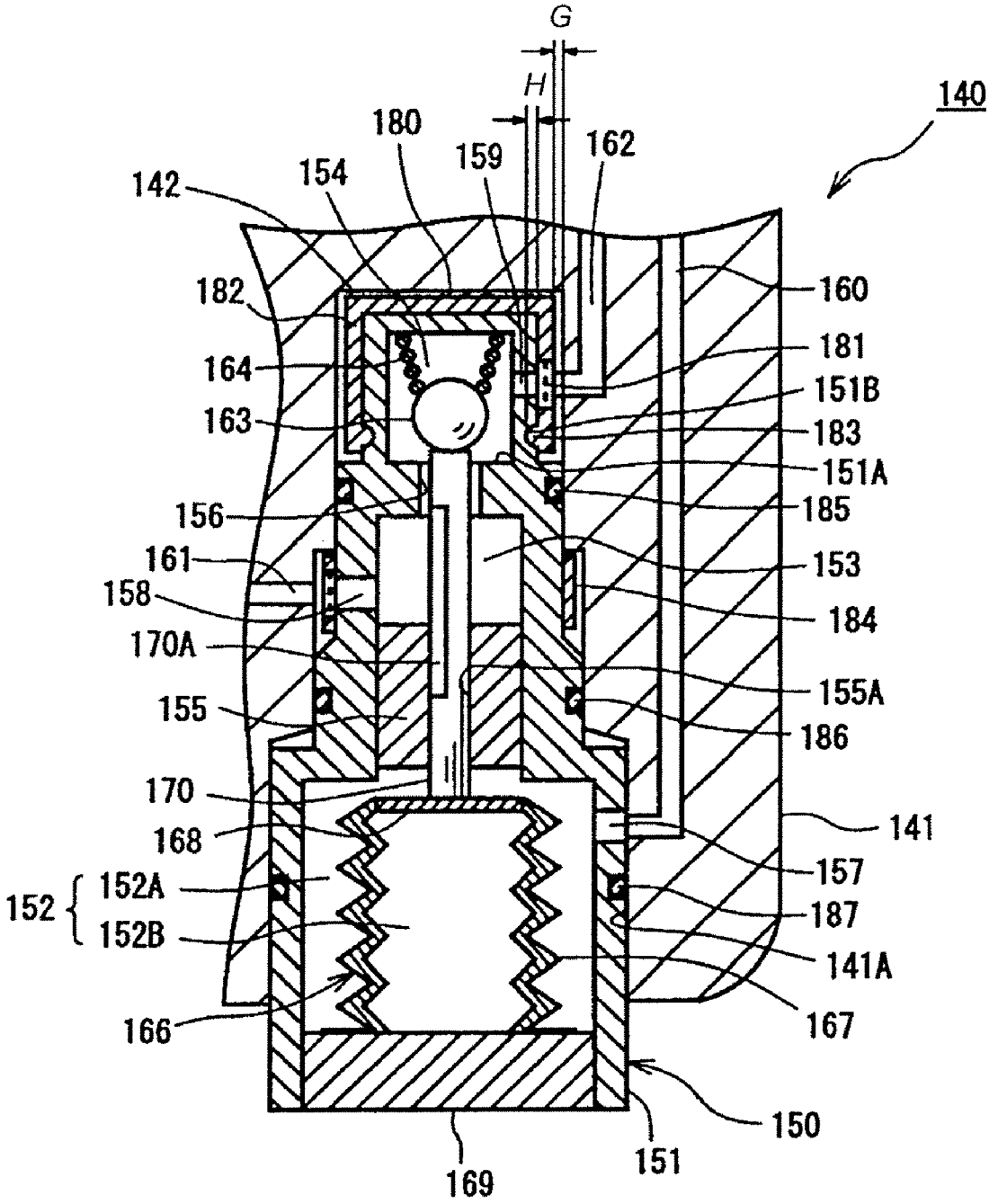
FIG. 13 is a fragmentary enlarged longitudinal sectional view showing a structure for mounting a filter of a compressor according to a fifth embodiment of the present invention.

The following will describe the structure for mounting a filter in a variable displacement type swash plate compressor according to the fifth embodiment of the present invention with reference to FIG. 13. The fifth embodiment differs from the third embodiment in that the rear housing 61 and the displacement control valve 71 of the third embodiment are modified. For the sake of convenience of explanation, therefore, like or same parts or elements will be referred to by the same reference numerals as those which have been used in the third embodiment, and the description thereof will be omitted. The rear housing 141 of the compressor 140 of the present embodiment has therein a suction chamber, a discharge chamber (neither being shown) and a valve receiving hole 142 with its upper end closed for receiving therein a displacement control valve 150. This displacement control valve 150 serves as a mounting member of the present invention. The valve receiving hole 142 is formed by boring the rear housing 141 radially from the lower side thereof. The valve receiving hole 142 is formed so as to complement the outer shape of the displacement control valve 150 and designed to receive therein the displacement control valve 150. The valve receiving hole 142 has an inner circumferential surface 141A. The inner circumferential surface 141A is formed with a plurality of stepped portions so that the diameter of the valve receiving hole 142 decreases progressively inwardly from the opened bottom end of the valve receiving hole 142.

Unlike the externally-controlled displacement control valve 71 of the third embodiment, the displacement control valve 150 of the present embodiment is internally controlled, according to which the displacement of the compressor 140 is controlled by changing the opening of the supply passage in accordance with pressure variation in the suction chamber. The control valve 150 includes a valve case 151, a spherical valve body 163, a pressure sensitive mechanism 166 and a rod 170. The valve case 151 has a substantially tubular shape and a plurality of chambers therein. The spherical valve body 163 is operable to open and close a passage formed in the control valve 150. The pressure sensitive mechanism 166 operates in accordance with pressure variation in the suction chamber. The rod 170 is moved by the pressure sensitive mechanism 166.

The valve case 151 has therein a pressure sensitive chamber 152, a communication chamber 153 and a valve chamber 154. The pressure sensitive chamber 152 is located adjacent to the lower end of the valve case 151, the valve chamber 154 adjacent to the upper end of the valve case 151 and the communication chamber 153 is formed between the pressure sensitive chamber 152 and the valve chamber 154. A separation member 155 having an axial shaft hole 155A is inserted in the valve case 151 to separate the pressure sensitive chamber 152 and the communication chamber 153. The valve case 151 has a partition 151A to separate the communication chamber 153 and the valve chamber 154. The partition 151A has therethrough an axial valve hole 156. The valve case 151 has therethrough an upper port 159, a middle port 158 and a lower port 157. The upper port 159 is in communication with the valve chamber 154, the middle port 158 with the communication chamber 153 and the lower port 157 with the pressure sensitive chamber 152, respectively. As shown in FIG. 13, the upper port 159 is in communication with the discharge chamber via a passage 162, the middle port 158 with the crank chamber 14 via a passage 161 and the lower port 157 with the suction chamber via a passage 160, respectively. The passages 161 and 162 provide a supply passage through which refrigerant gas under a discharge pressure flows. The communication passages 161 and 162 serve as a refrigerant passage which allows refrigerant gas to flow and also serve as a fluid passage of the present invention.

The upper port 159, the valve chamber 154, the valve hole 156, the communication chamber 153 and the middle port 158 cooperate to form part of the supply passage in the valve case 151, through which the passages 161 and 162 communicate with each other. The valve body 163 and a coil spring 164 are disposed in the valve chamber 154. The valve body 163 has a diameter larger than that of the valve hole 156, so that the fluid communication between the valve chamber 154 and the communication chamber 153 can be shut off by the valve body 163 then closing the valve hole 156. The valve body 163 is urged by the coil spring 164 in the direction that closes the valve hole 156.

The pressure sensitive mechanism 166 is disposed in the pressure sensitive chamber 152. The pressure sensitive mechanism 166 has a bellows 167 and a movable member 168, which divide the pressure sensitive chamber 152 into a variable pressure chamber 152A and a constant pressure chamber 152B. The valve case 151 is closed at its lower end by an end wall member 169. The lower end of the bellows 167 is fixed to the end wall member 169 and the upper end of the bellows 167 is fixed to the movable member 168. The constant pressure chamber 152B inside the bellows 167 is hermetically closed and kept under a constant pressure. The variable pressure chamber 152A outside the bellows 167 is located so as to surround the constant pressure chamber 152B and the pressure in the variable pressure chamber 152A varies in accordance with the pressure change in the suction chamber. Therefore, when the pressure in the variable pressure chamber 152A is lower than that in the constant pressure chamber 152B, the bellows 167 expands. When the pressure in the variable pressure chamber 152A is higher than that in the constant pressure chamber 152B, on the other hand, the bellows 167 contracts. Thus, the pressure difference between the constant pressure chamber 152B and the variable pressure chamber 152A causes the bellows 167 to expand or contract.

The movable member 168 of the pressure sensitive mechanism 166 is fixed to the lower end of the rod 170. In the present embodiment, the rod 170 has a diameter slightly smaller than that of the shaft hole 155A and such an axial length that allows the valve body 163 to be moved away from the valve hole 156 against the urging force of the coil spring 164 when the bellows 167 is fully expanded. The rod 170 has at the intermediate portion thereof a recess 170A along the axial direction of the rod 170. The recess 170A establishes fluid communication between the pressure sensitive chamber 152 and the communication chamber 153 when the bellows 167 is fully contracted. The middle port 158, the communication chamber 153, the recess 170A, the pressure sensitive chamber 152 and the lower port 157 cooperate to form part of the bleed passage, whose main purpose is to deliver liquid refrigerant reserved in the crank chamber 14 to the suction chamber in starting the compressor 140.

The middle port 158 in communication with the crank chamber 14 is provided with a filter 184 for eliminating foreign substances such as dust from refrigerant gas. The upper port 159 in communication with the discharge chamber is provided with a filter 180. The filter 184 has a substantially tubular shape and covers the middle port 158 from the outer circumferential surface of the valve case 151. The filter 184 having substantially the same structure as the filter 106 of the third embodiment includes a filter screen facing the middle port 158 and a holding member for holding the filter screen. The filter 184 serves to eliminate foreign substances such as dust from the refrigerant gas returning from the crank chamber 14 to the space inside the control valve 150, so that the control valve 150 is prevented from failing to operate properly due to such foreign substances.

The filter 180 for the upper port 159 in communication with the discharge chamber serves to eliminate foreign substances from the refrigerant gas introduced from the discharge chamber to the space inside the control valve 150. The filter 180 is in the form of a tube with its upper end closed, and mounted to the upper end of the control valve 150. The filter 180 includes a filter screen 181 for covering the upper port 159 and a holding member 182 for holding the filter screen 181. The filter 180 has substantially the same structure as the filter 110 of the third embodiment. A projection 183 is formed on the inner circumferential surface of the holding member 182 over the entire circumference thereof and at a position adjacent to the lower end of the filter 180, projecting toward the central axis of the valve receiving hole 142. A recess 151B is formed on the outer circumferential surface of the valve case 151 over the entire circumference thereof and at a position corresponding to the projection 183, receding toward the central axis of the valve receiving hole 142.

The projection 183 of the filter 180 is fitted in the recess 151B of the valve case 151. The projection 183 serves as a first fitting portion of the present invention and the recess 151B as a second fitting portion of the present invention. With the projection 183 fitted in the recess 151B, the filter 180 is held by the valve case 151. As shown in FIG. 13, the projection 183 is fitted in the recess 151B for the overlap distance H. When the projection 183 is moved away from the recess 151B radially outward of the valve receiving hole 142 for the overlap distance H, the filter 180 becomes removable from the valve case 151.

With the control valve 150 received in place in the valve receiving hole 142, there is formed a clearance having a dimension G between the outer circumferential surface of the holding member 182 of the filter 180 and the inner circumferential surface 141A of the valve receiving hole 142. The dimension G of the clearance of the present embodiment is uniform over the axial length of the holding member 182 of the filter 180. In the present embodiment, the dimension G is smaller than the overlap distance H, or G<H. Therefore, with the displacement control valve 150 received in place in the valve receiving hole 142, the filter 180 is prevented from being removed from the valve case 151.

O-rings 185, 186, 187 are provided in the outer circumferential surface of the control valve 150 and each of the O-rings 185-187 serves as a sealing member. The O-ring 185 is located between the middle port 158 and the lower port 159 to create a seal between the outer circumferential surface of the control valve 150 and the inner circumferential surface 141A of the valve receiving hole 142, thus preventing flow of refrigerant gas between the middle port 158 and the lower port 159. The O-ring 186 is located between the upper port 157 and the middle port 158 to create a seal between the outer circumferential surface of the control valve 150 and the inner circumferential surface 141A of the valve receiving hole 142, thus preventing flow of refrigerant gas between the upper port 157 and the middle port 158. The O-ring 187 prevents refrigerant gas in the valve receiving hole 142 from leaking out of the valve receiving hole 142.

The control valve 150 is operable to control the displacement of the compressor 140. When the cooling load decreases and suction pressure decreases, the valve body 163 opens the valve hole 156 to supply refrigerant gas under a discharge pressure into the crank chamber 14 thereby to increase the pressure in the crank chamber 14, with the result that the displacement of the compressor 140 is reduced. When the cooling load increases and suction pressure increases, on the other hand, the valve body 163 closes the valve hole 156 to stop supplying refrigerant gas under a discharge pressure into the crank chamber 14 thereby to decrease the pressure in the crank chamber 14, and the displacement of the compressor 140 is increased, accordingly. The internally controlled valve 150 according to the present embodiment has substantially the same effects as the internally controlled valve 71 of the third embodiment.

The following will describe the structure for mounting a filter in a variable displacement type swash plate compressor according to the sixth embodiment of the present invention with reference to FIGS. 14 through 17. The sixth embodiment differs from the first embodiment in that the rear housing 13 of the first embodiment is modified and the suction throttle valve 33 of the first embodiment is eliminated. The rear housing 201 of the compressor 200 of the present embodiment has therein an oil separation chamber 211 for receiving therein an oil separator 215. In the oil separation chamber 211 is provided a filter 222. For the sake of convenience of explanation, therefore, like or same parts or elements will be referred to by the same reference numerals as those which have been used in the first embodiment, and the description thereof will be omitted.

Figure 14:
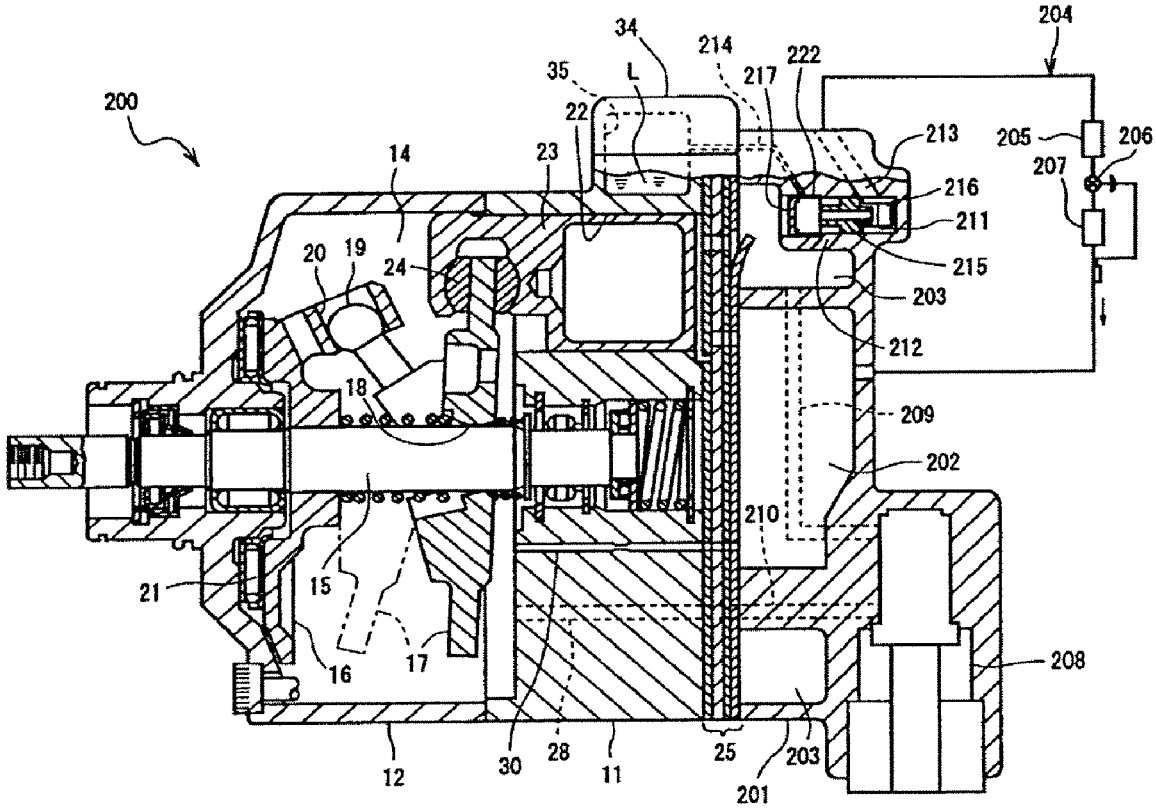
FIG. 14 is a longitudinal sectional view showing a compressor according to a sixth embodiment of the present invention.

Referring to FIG. 14, the valve plate assembly 25 and the rear housing 201 define a suction chamber 202 located radially inward in the rear housing 201 and a discharge chamber 203 located radially outward so as to surround the suction chamber 202. The suction chamber 202 and the discharge chamber 203 are connected to an external refrigerant circuit 204 of the compressor 200. The external refrigerant circuit 204 includes a condenser 205 which absorbs heat from the refrigerant gas, an expansion valve 206 and an evaporator 207 which transfers ambient heat to the refrigerant gas. The expansion valve 206 is operable to sense the temperature of the refrigerant gas at the outlet of the evaporator 207 and to control the flow of refrigerant gas according to the variation in temperature. High-pressure refrigerant gas discharged to the discharge chamber 203 is delivered to the external refrigerant circuit 204. Low-pressure refrigerant gas is introduced into the suction chamber 202 through the external refrigerant circuit 204. The region in the external refrigerant circuit 204 downstream of the evaporator 207 and up to the suction chamber 202 of the compressor 200 serves as a suction pressure region of the present invention. Refrigerant gas in the suction pressure region is under a suction pressure or a pressure close to the suction pressure.

The rear housing 201 has therein part of the supply passage connecting the discharge chamber 203 and the crank chamber 14. The rear housing 201 is provided with a displacement control valve 208 for controlling the flow rate of the refrigerant gas flowing through the supply passage. The control valve 208 is externally controlled and disposed in the middle of the supply passage. The rear housing 201 has therein a first passage 209 connecting the discharge chamber 203 and the control valve 208 and a second passage 210 connecting the control valve 208 and the communication passage 28 formed in the cylinder block 11. Thus, the supply passage includes the first passage 209, the second passage 210 and the communication passage 28. Controlling the flow rate of the refrigerant gas flowing through the supply passage by the control valve 208, the pressure in the crank chamber 14 is changed and the angle of inclination of the swash plate 17 is altered, accordingly. The bleed passage 30 formed in the cylinder block 11 provides fluid communication between the crank chamber 14 and the suction chamber 202, serving to release the pressure in the crank chamber 14.

Figure 15:
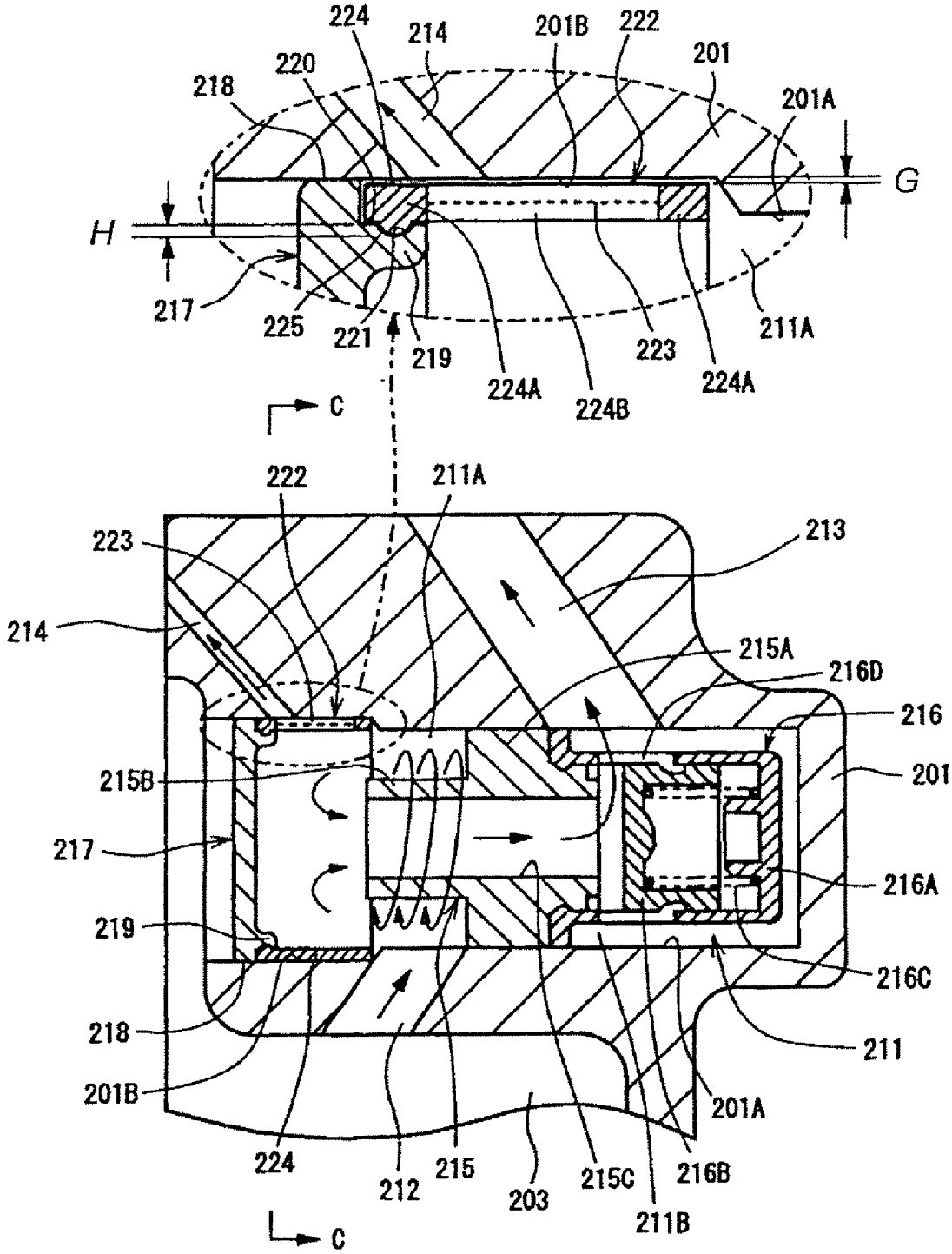
FIG. 15 is a fragmentary enlarged longitudinal sectional view showing a structure for mounting a filter in the compressor according to the sixth embodiment of the present invention.

The rear housing 201 has therein a discharge passage connecting the discharge chamber 203 and the external refrigerant circuit 204. The discharge passage includes the oil separation chamber 211, an introduction passage 212 and a delivery passage 213. The oil separation chamber 211 has a cylindrical shape and communicates with the discharge chamber 203 via the introduction passage 212. This introduction passage 212 is opened to the oil separation chamber 211 at an intermediate position thereof in the axial direction. The oil separation chamber 211 communicates with the external refrigerant circuit 204 via the delivery passage 213. This delivery passage 213 is opened to the oil separation chamber 211 at a position adjacent to the rear end thereof. The oil separation chamber 211 of the present embodiment serves as a receiving hole of the present invention. The oil separation chamber 211 extending parallel to the axis of the rotary shaft 15 is formed by boring the rear housing 201 from the discharge chamber 203 rearward. Referring to FIG. 15, the rear housing 201 has an inner wall surface 201A forming major part of the oil separation chamber 211 and an enlarged inner wall surface 201B whose radius of curvature is larger than that of the inner wall surface 201A and which is located in the front of the oil separation chamber 211. As shown in FIGS. 14 and 15, an oil passage 214 is formed in the rear housing 201 and the cylinder block 11 for connecting the oil separation chamber 211 and the oil reservoir 35. The oil passage 214 is opened to the oil separation chamber 211 at a position adjacent to the front end thereof. The oil reservoir 35 is provided by the cylinder block 11 and the oil reservoir forming member 34 joined on the top peripheral surface of the cylinder block 11.

Figure 16:
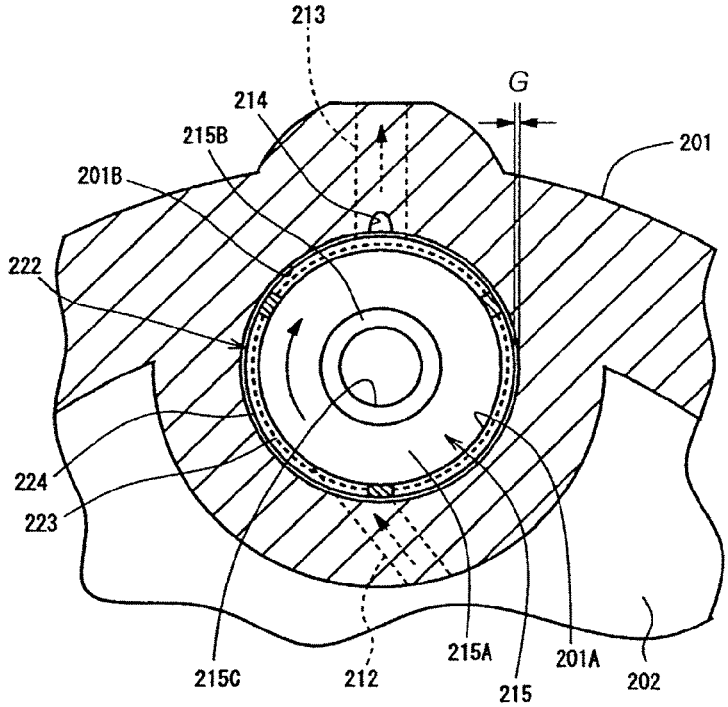
FIG. 16 is a cross sectional view of the filter and its related parts taken along the line C-C of FIG. 15.

The oil separator 215 is fixedly inserted in the oil separation chamber 211 at a middle position thereof in the axial direction. A cover member 217 is inserted in the oil separation chamber 211 at the enlarged inner wall surface 201B, serving as a mounting member of the present invention. The oil separator 215 and the cover member 217 inserted in the oil separation chamber 211 have therebetween an oil separation space 211A, which communicates with the introduction passage 212 and the oil passage 214. As shown in FIG. 15, the introduction passage 212 is formed through the rear housing 201 at such an angle with respect to the axis of the oil separation chamber 211 that the upstream end of the introduction passage 212 adjacent to the discharge chamber 203 is located forward of the downstream end of the same introduction passage 212 adjacent to the oil separation chamber 211. Referring to FIG. 16, the introduction passage 212 is formed in the rear housing 201 with such an inclination relative to the axial direction of the oil separation chamber 211 that refrigerant gas introduced through the introduction passage 212 flows into the oil separation space 211A in tangential relation to the inner wall surface 201A of the oil separation chamber 211. As a result, the refrigerant gas in the oil separation space 211A tends to swirl along the inner circumferential surface 201A around the oil separator 215. Referring back to FIG. 15, the oil separation chamber 211 has a valve space 211B in the rear of the oil separator 215, in which a check valve 216 is disposed for preventing the refrigerant gas under a discharge pressure from flowing reverse. The check valve 216 is connected to the oil separator 215 at the rear end thereof in the valve space 211B and the valve space 211B communicates with the delivery passage 213. The delivery passage 213 is inclined relative to a plane perpendicular to the axis of the rotary shaft 15 in such a way that the downstream end of the delivery passage 213 adjacent to the external refrigerant circuit 204 is located forward of the upstream end of the delivery passage 213 adjacent to the oil separation chamber 211.

The oil separator 215 has a base 215A fixed to the inner wall surface 201A and having an axial protrusion 215B that extends forward, and an axial hole 215C is formed through the base 215A. The oil separator 215 serves to separate misty oil contained in the refrigerant gas under a discharge pressure in the oil separation space 211A. The check valve 216 includes a valve case 216A, a valve body 216B and an urging member 216C. The valve case 216A is connected to the oil separator 215 at the rear end thereof. The valve body 216B is disposed reciprocally movably in the valve case 216A. The urging member 216C urges the valve body 216B forward. The pressure of the refrigerant gas in the oil separation space 211A acts on the valve body 216B rearward. The valve body 216B is moved rearward against the urging force of the urging member 216C according to the variation in the pressure of refrigerant gas in the oil separation space 211A. The valve case 216A has through the periphery thereof a valve hole 216D through which refrigerant gas passes when the valve body 216B is moved rearward. The area of the valve hole 216D which allows refrigerant gas to pass therethrough varies according to the movement of the valve body 216B.

The cover member 217 closes the oil separation chamber 211 at the front end thereof and it is provided with a filter 222 for covering the oil passage 214 at the inlet thereof. The cover member 217 is fixedly fitted in the enlarged inner wall surface 201B and has an outer circumferential surface 218 which is in contact with the enlarged inner wall surface 201B. An annular protrusion 219 is formed on the rear surface of the cover member 217 so as to project rearward. The protrusion 219 has an outer circumferential surface 220 whose radius of curvature is smaller than that of the outer circumferential surface 218 of the cover member 217, so that there exists a clearance between the outer circumferential surface 220 and the enlarged inner wall surface 201B. A recess 221 is formed on the outer circumferential surface 220 of the protrusion 219 for connecting the filter 222 to the cover member 217. The recess 221 is formed over the entire circumference of the annular protrusion 219 so as to recede from the outer circumferential surface 220 of the protrusion 219 toward the central axis of the oil separation chamber 211. The recess 221 has an arcuate shape as viewed in the radial section of the cover member 217.

Figure 17:
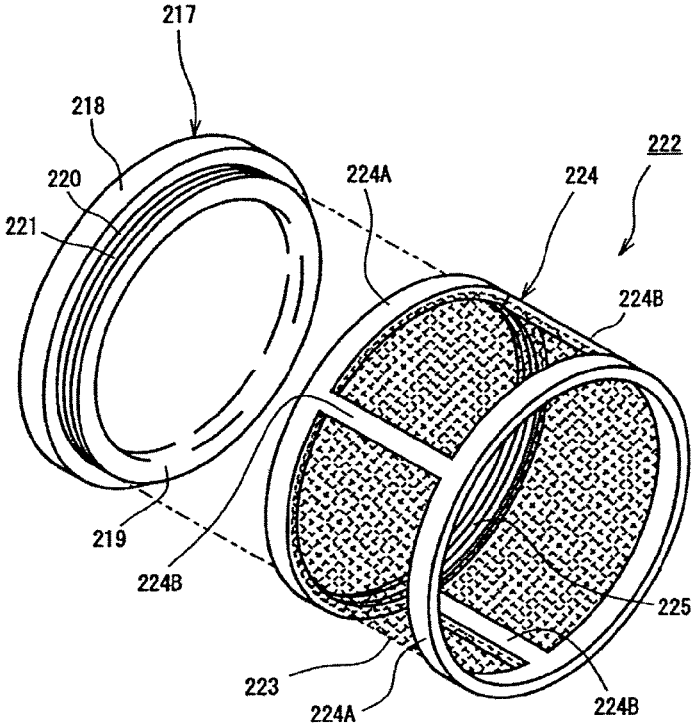
FIG. 17 is a perspective exploded view showing the filter and its cover member according to the sixth embodiment of the present invention.

The filter 222 has a filter screen 223 covering the inlet of the oil passage 214 and a holding member 224 for holding the filter screen 223. The holding member 224 serves as a holding portion of the present invention. The holding member 224 is made of a resilient resin. As shown in FIGS. 15 and 17, the holding member 224 has front and rear annular end portions 224A spaced at a predetermined distance, and a plurality of connection portions 224B connecting the annular end portions 224A. The annular end portions 224A and the connection portions 224B cooperate to define a plurality of openings between any two adjacent connection portions 224B and the openings are covered with a filter screen 223. With the cover member 217 inserted in place in the oil separation chamber 211, the filter screen 223 is located so as to cover the inlet of the oil passage 214, as will be described in later part hereof. On the other hand, a projection 225 is formed on the inner circumferential surface of the front annular end portion 224A adjacent to the cover member 217 over the entire circumference of the front annular end portion 224A so as to project toward the central axis of the holding member 224. The projection 225 of the holding member 224 has an arcuate shape as viewed in the radial section of the holding member 224 and is fitted in the recess 221 of the cover member 217. The projection 225 and the recess 221 serve as a first fitting portion and a second fitting portion of the present invention, respectively. As apparent from the enlarged view of FIG. 15, the arcuate shapes of the projection 225 and the recess 221 are complementary to each other. The provision of such a part of complementary arcuate projection 225 and recess 221 facilitates the connection and removal of the filter 222 to and from the cover member 217, as will be described below.

In the present embodiment, the projection 225 is fitted in the recess 221 to connect the filter 222 to the cover member 217. As shown in FIG. 15, the projection 225 is fitted in the recess 221 for the overlap distance H. When the projection 225 is moved from the recess 221 radially outward of the oil separation chamber 211 for the overlap distance H, the filter 222 becomes removable from the cover member 217. When connecting the filter 222 to the cover member 217, the filter 222 is fitted onto the cover member 217 from behind the cover member 217. Before the projection 225 reaches the recess 221, the front annular end portion 224A of the holding member 224 is enlarged radially outward for the overlap distance H. Further moving the filter 222 onto the protrusion 219 of the cover member 217 until the projection 225 reaches the recess 221, the projection 225 is fitted in the recess 221 thereby to connect the filter 222 to the cover member 217.

With the cover member 217 inserted in place in the oil separation chamber 211, as shown in FIGS. 15 and 16, there is a clearance having a dimension G between the outer circumferential surface of the holding member 224 and the enlarged inner wall surface 201B. The dimension G of the clearance of the present embodiment is uniform over the axial length of the holding member 224. In the present embodiment, the dimension G is smaller than the overlap distance H, or G<H. Therefore, with the cover member 217 inserted in place in the oil separation chamber 211, the filter 222 is prevented from being removed from the cover member 217.

The following will describe the operation of the compressor 200. During operation of the compressor 200, refrigerant gas in the discharge chamber 203 flows into the oil separation space 211A through the introduction passage 212. The introduction passage 212 is formed through the rear housing 201 at such an angle with respect to the axis of the oil separation chamber 211 that the upstream end of the introduction passage 212 adjacent to the discharge chamber 203 is located forward of the downstream end of the same introduction passage 212 adjacent to the oil separation chamber 211. In addition, the introduction passage 212 is formed in the rear housing 201 with such an inclination relative to the axial direction of the oil separation chamber 211 that refrigerant gas introduced through the introduction passage 212 flows into the oil separation space 211A in tangential relation to the inner wall surface 201A of the oil separation chamber 211. Therefore, refrigerant gas introduced in the oil separation space 211A is caused to swirl around the oil separator 215, as indicated by arrows in FIG. 15. Then, the refrigerant gas flows forward along the inner wall surface 201A of the oil separation chamber 211 while swirling in the space between the inner wall surface 201A and the outer circumferential surface of the protrusion 215B of the oil separator 215. When the refrigerant gas in the oil separation space 211A flows forward, oil contained in the refrigerant gas in the form of a mist is separated from the refrigerant gas by the centrifugal force of the swirling flow of the refrigerant gas.

After moving past the front end of the protrusion 215B, refrigerant gas in the oil separation chamber 211 flows forward while swirling around the axis of the oil separation space 211A and part of the refrigerant gas collides against the cover member 217. Because the filter 222 is present between the cover member 217 and the oil separator 215 in the oil separation chamber 211, the swirling refrigerant gas collides against the filter 222, so that the oil remaining in the refrigerant gas is further separated. Refrigerant gas whose oil is separated flows toward the check valve 216 through the axial hole 215C of the oil separator 215. When the refrigerant gas is under a predetermined pressure or higher, the valve body 216 B of the check valve 216 is moved rearward against the urging force of the urging member 216C thereby to open the valve hole 216D. As a result, refrigerant gas is delivered to the external refrigerant circuit 204 through the delivery passage 213.

Because the oil separated by the oil separator 215 and the filter 222 is centrifuged, more oil exists in the area closer to the enlarged inner wall surface 201B on the rear end surface of the cover member 217. The separated oil is moved along the enlarged inner wall surface 201B by the swirling action of the refrigerant gas. The oil reservoir 35 is in communication with the suction chamber 202 that is a part of the suction pressure region of the compressor 200 via an oil return passage (not shown). Compared to the oil separation space 211A in which the refrigerant gas is under a discharge pressure, the oil reservoir 35 is placed under an intermediate pressure between the pressure in the suction pressure region and the pressure in the discharge pressure region. Due to the pressure difference between the oil separation space 211A and the oil reservoir 35, the oil separated in the oil separation space 211A flows into the oil reservoir 35 through the filter screen 223 and the oil passage 214. Any foreign substances which are larger than the mesh size of the filter screen 223 are eliminated from the oil by the filter screen 223.

If the holding member 224 is expanded radially outward, e.g. due to factors such as a temperature rise, the dimension G of the clearance decreases because of the relation G<H. When the holding member 224 is expanded fully, the outer circumferential surface of the holding member 224 is brought into contact with the enlarged inner wall surface 201B and the dimension G of the clearance becomes zero, or G=0. At the same time, a radial clearance with a dimension that is substantially the same as the dimension G is formed between the recess 221 and the projection 225. Because of the dimensional relation G<H, the dimension of this clearance will not exceed the overlap distance H. That is, the filter 222 is prevented from being removed from the cover member 217.

According to the present embodiment, the oil separator 215 and the filter 222 are mounted to the rear housing 201 as follows. After the check valve 216 is connected to the oil separator 215, the connected oil separator 215 and check valve 216 are fixedly inserted in place in the oil separation chamber 211. Then, with the filter 222 connected to the cover member 217, the connected cover member 217 and filter 222 are also fixedly inserted in place in the oil separation chamber 211. In inserting the cover member 217 into the oil separation chamber 211, the cover member 217 is located in the enlarged inner wall surface 201B so that the filter 222 then covers the oil passage 214.

The structure for mounting the filter in the compressor according to the sixth embodiment has the following advantageous effects.

(12) The recess 221 is formed on the outer circumferential surface of the protrusion 219 of the cover member 217, while the projection 225 is formed on the inner circumferential surface of the holding member 224 of the filter 222. With the projection 225 fitted in the recess 221, the cover member 217 and the filter 222 are connected together. A clearance with a uniform dimension G is formed between the outer circumferential surface of the holding member 224 and the enlarged inner wall surface 201B forming part of the oil separation chamber 211. This dimension G is smaller than the overlap distance H for which the projection 225 is fitted in the recess 221 (i.e. G<H). If the holding member 224 is expanded radially outward, e.g. due to factors such as a thermal expansion, therefore, the fitting relation between the recess 221 and the projection 225 remains effective thereby to prevent the filter 222 from being removed from the cover member 217.

(13) After the filter 222 and the cover member 217 are connected together by fitting the projection 225 into the recess 221, the cover member 217 is inserted in place in the oil separation chamber 211 so as to be fixed to the enlarged inner wall surface 201B. Thus, the cover member 217 and the oil separator 215 are separately fixed into the oil separation chamber 211. In replacing the filter 222 with a new one or cleaning the filter 222, only the cover member 217 needs to be removed from the rear housing 201, but the oil separator 215 does not need to be removed from the rear housing 201.

Figure 18:
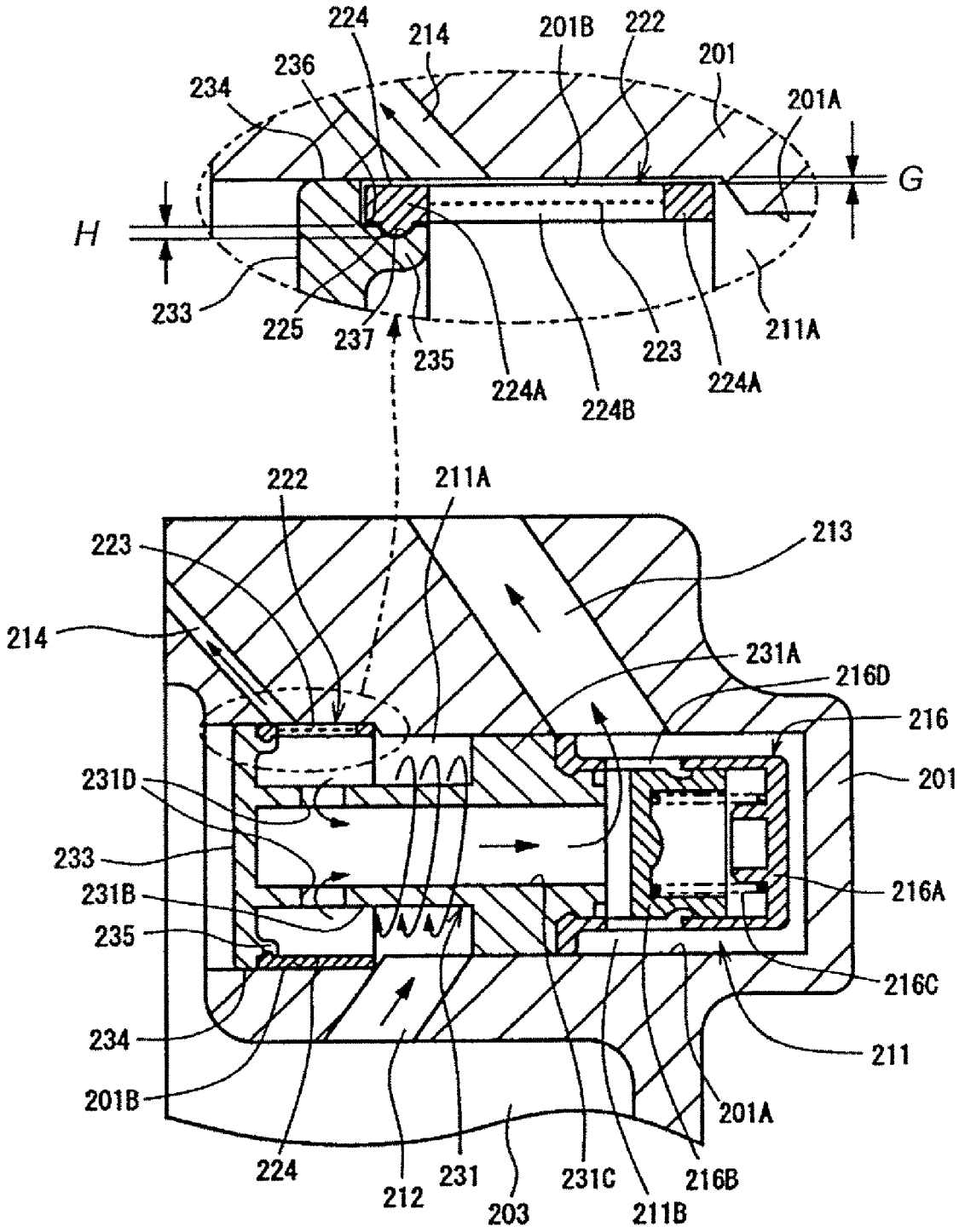
FIG. 18 is a view similar to FIG. 15, but showing a structure for mounting a filter in a compressor according to a seventh embodiment of the present invention.

The following will describe the structure for mounting a filter in a compressor according to the seventh embodiment of the present invention with reference to FIG. 18. The seventh embodiment differs from the sixth embodiment in that the oil separator 215 and the cover member 217 of the sixth embodiment are formed integrally. For the sake of convenience of explanation, therefore, like or same parts or elements will be referred to by the same reference numerals as those which have been used in the first and sixth embodiments, and the description thereof will be omitted.

Referring to FIG. 18, an oil separator 231 is fixedly inserted in the oil separation chamber 211 of the rear housing 201. The oil separator 231 includes a base 231A, an axial protrusion 231B and a cover portion 233, all of which are formed integrally, and also formed therethrough an axial hole 231C. The cover portion 233 serves as a mounting member. The protrusion 231B has through the periphery thereof a communication hole 231D through which the oil separation space 211A is in communication with the axial hole 231C of the oil separator 231. Refrigerant gas introduced from the introduction passage 212 into the oil separation space 211A of the oil separation chamber 211 is delivered to the delivery passage 213 through the communication hole 231D, the axial hole 231C and the valve space 211B.

With the oil separator 231 fixed in the oil separation chamber 211, the cover portion 233 closes the front end of the oil separation chamber 211. The cover portion 233 has the filter 222, which covers the inlet of the oil passage 214. The oil separator 231 is fixedly inserted in the oil separation chamber 211 so that the outer circumferential surface 234 of the cover portion 233 is in contact with the enlarged inner wall surface 201B. The cover portion 233 is formed at a position adjacent to the outer periphery thereof with an annular protrusion 235 extending rearward. The protrusion 235 has an outer circumferential surface 236 whose radius of curvature is smaller than that of the outer circumferential surface 234, so that there exists a clearance between the outer circumferential surface 236 and the enlarged inner wall surface 201B. A recess 237 is formed on the outer circumferential surface 236 of the protrusion 235 for connecting the filter 222 to the oil separator 231. The recess 237 is formed over the entire circumference of the protrusion 235, receding toward the central axis of the oil separation chamber 211. The recess 237 serves as a second fitting portion of the present invention. The recess 237 has an arcuate shape as viewed in the radial section of the cover portion 233.

The filter 222 of the present embodiment has the same structure as that of the sixth embodiment. That is, the filter 222 has the filter screen 223 and the holding member 224 for holding the filter screen 223. In connecting the filter 222 to the cover portion 233 in the present embodiment wherein the oil separator 231 is formed integrally with the cover portion 233, the base 231A of the oil separator 231 needs to be inserted into the holding member 224. Therefore, the inside diameter of the holding member 224 is larger than the outside diameter of the base 231A. In the present embodiment, the projection 225 is fitted in the recess 237 to connect the filter 222 to the cover portion 233. As shown in FIG. 18, the projection 225 is fitted in the recess 237 for the overlap distance H. When the projection 225 is moved away from the recess 237 radially outward of the oil separation chamber 211 for the overlap distance H, the filter 222 becomes removable from the cover portion 233. In connecting the filter 222 to the cover portion 233, the filter 222 is fitted onto the cover portion 233 with the base 231A inserted through the holding member 224. Before the projection 225 of the filter 222 reaches the recess 237 of the cover portion 233, the front annular end portion 224A of the holding member 224 is enlarged radially outward for the overlap distance H. When the filter 222 is further fitted onto the cover portion 233 so that the projection 225 reaches the recess 237, the projection 225 is fitted in the recess 237 thereby to connect the filter 222 to the cover portion 233.

In the present embodiment, after the filter 222 is connected to the cover portion 233 of the oil separator 231, the check valve 216 is then connected to the base 231A of the oil separator 231. Then, the oil separator 231 having the filter 222 and the check valve 216 connected thereto is fixedly inserted in the oil separation chamber 211. At the same time, the cover portion 233 is inserted into the oil separation chamber 211 so that the filter 222 covers the inlet of the oil passage 214.

The structure for mounting the filter in the compressor according to the seventh embodiment has the following advantageous effect.

(14) If the holding member 224 is expanded radially outward, e.g., due to factors such as a thermal expansion, the fitting relation between the recess 237 and the projection 225 remains effective, so that the filter 222 is prevented from being removed from the cover portion 233. After the projection 225 is fitted in the recess 237 thereby to connect the filter 222 to the cover portion 233, the check valve 216 is connected to the oil separator 231, so that the oil separator 231 is provided with the filter 222 and the check valve 216 before being inserted into the oil separation chamber 211. Therefore, by inserting the oil separator 231 into the oil separation chamber 211, the cover portion 233 of the oil separator 231 can be fixed to the enlarged inner wall surface 201B. Thus, the oil separator 231 and the cover portion 233 can be inserted into the oil separation chamber 211 simultaneously. Therefore, compared to the case wherein the oil separator 215 and the cover member 217 are provided separately as in the case of the sixth embodiment of the present invention, trouble in mounting the oil separator 231 and the cover portion 233 into the rear housing 201 is reduced.

The structure for mounting the filter in the compressor according to the present invention is not limited to the above-described first embodiment through the seventh embodiment, but it may be practiced variously within the scope of the invention as exemplified below.

Although in the first and second embodiments the recess is formed on the outer circumferential surface of the connection portion and the projection is formed on the inner circumferential surface of the holding member, it may be so arranged that the projection is formed on the outer circumferential surface of the connection portion and the recess is formed on the inner circumferential surface of the holding member. It is not necessary to provide the projection and the recess over the entire circumference. Plural projections and plural recesses may be provided equiangularly.

Although in the second embodiment two protrusions 52B are provided, three or more protrusions 52B may be provided. Alternatively, a single protrusion may be provided annularly over the entire circumference. When the protrusion is provided over the entire circumference, a clearance with the dimension g will be formed over the entire circumference. Because this dimension g is smaller than the diameter s of the throttle hole, the throttle hole will not be clogged with foreign substances entering into the oil filter through the clearance.

Although in the second embodiment only the dimension g of the clearance between the outer circumferential surface of the protrusions and the inner circumferential surface of the mounting hole is smaller than the diameter s of the throttle hole 37A, the clearance between the outer circumferential surface of the holding member 52 other than the outer circumferential surfaces 52C of the protrusions 52B and the inner circumferential surface 11B of the mounting hole 11A may be formed with a clearance that is also smaller than the diameter s of the throttle hole 37A. In this case, the throttle hole is prevented from being clogged with any foreign substances entering into the oil filter through the above clearance between the outer circumferential surface of the holding member 52 other than the outer circumferential surfaces 52C of the protrusions 52B and the inner circumferential surface 11B of the mounting hole 11A.

Although in the first and second embodiments the throttle member 37 is made of a resin and the holding member 38B is made of a metal, the throttle member 37 is made of a metal and the holding member 38B is made of a resin. Alternatively, both of the throttle member and the holding member may be made of either a metal or a resin.

Although in the third through seventh embodiments the annular projection of the filter is formed over the entire circumference so as to project radially inward, this projection may have a hemispherical shape. In this case, it is preferable to provide plural projections and their corresponding plural recesses each having a complementary hemispherical shape in which the respective projections are fitted. The projection and the recess do not necessarily have an arcuate shape as viewed in their section. They may have a V shape or U shape. The projection and the recess may take any shape as long as the projection and the recess have fitting relation with uneven surface.

In the first embodiment and the third through seventh embodiments, the filter is mounted to the receiving hole so as to be coaxial therewith. Specifically, the dimension of the clearance between the filter and the receiving hole is uniform over the entire circumference of the holding portion of the filter. Due to the dimensional tolerance, however, the filter may be mounted to the receiving hole so as not to be coaxial therewith. In this case, the dimensions of the clearances between the filter and the receiving hole may not be uniform over the entire circumference of the holding portion of the filter. Specifically, the dimensions of the clearances may have minimum value and maximum value. As long as the minimum value is set smaller than the overlap distance in mounting the filter to the receiving hole, the fitting relation between the filter and the mounting member remains effective irrespective of the maximum value.

Although in the third through fifth embodiments the valve case of the displacement control valve has therein at a position adjacent to the upper end thereof a space for allowing refrigerant gas under a discharge pressure to pass therethrough, the present invention does not preclude the application of the present invention to a displacement control valve having a space formed adjacently to the top of its valve case through which refrigerant gas under a pressure other than discharge pressure passes.

In the sixth and seventh embodiments, the oil separation chamber 211 is formed by boring the rear housing 201 from the discharge chamber 203 rearward with the rear end wall of the rear housing 201 closed. However, the oil separation chamber may be formed by boring the rear housing from the outer circumferential wall of the rear housing radially inward with the inner part of the oil separation chamber closed. In this case, the cover member or the cover portion is disposed in the inner part of the oil separation chamber, and the oil separator at a position adjacent to the outer part of the oil separation chamber. The oil separation chamber has the oil separation space and the check valve space on the opposite sides of the oil separator. The introduction passage and the oil passage are formed so as to communicate with the oil separation space, and the delivery passage is formed so as to communicate with the valve space.

Although in sixth and seventh embodiments the check valve is connected to the oil separator, the check valve may not be necessarily connected to the oil separator. In this case, the check valve should preferably be located downstream of the oil separator in the discharge passage extending from the discharge chamber to the external refrigerant circuit.

Therefore, the present examples and embodiments are to be considered as illustrative and not restrictive, and the invention is not to be limited to the details given herein but may be modified within the scope of the appended claims.

What is claimed is:

1. A structure for mounting a filter in a compressor, comprising:

a mounting member connected to the filter;

a receiving hole formed in a housing of the compressor for receiving therein the mounting member;

wherein the filter has a filter screen and a holding portion for holding the filter screen;

an axial retention means for restricting axial movement of the filter relative to the housing, the axial retention means comprising a first fitting portion formed on an inner circumferential surface of the holding portion, and a second fitting portion formed on an outer circumferential surface of the mounting member for having fitting relation with uneven surface to the first fitting portion for an overlap distance in a radial direction of the receiving hole, wherein the filter is fixedly attached to the axial retention means;

a fluid passage formed in the housing, wherein when the mounting member is received in the receiving hole with the first fitting portion and the second fitting portion having the fitting relation, the filter is disposed in the fluid passage; and a clearance having a dimension formed between an outer circumferential surface of the holding portion and an inner circumferential surface of the receiving hole, wherein minimum value of the dimension of the clearance is smaller than the overlap distance.

2. The structure for mounting a filter in a compressor according to claim 1, further comprises an oil reservoir formed in the housing for reserving therein oil separated from refrigerant gas under a discharge pressure, wherein the fluid passage is an oil passage through which the oil in the oil reservoir flows into a region whose pressure is lower than pressure in the oil reservoir, wherein the receiving hole is formed in a part of the oil passage, wherein the mounting member is a throttle member having a throttle hole therethrough, wherein the throttle member is inserted in the oil passage, wherein the filter is an oil filter that is located in the oil upstream of the throttle member, wherein the throttle member has an outer circumferential surface and a connection portion, wherein the outer circumferential surface of the throttle member is in contact with an inner circumferential surface of the oil passage, wherein the connection portion of the throttle member is formed at an end of the throttle member adjacent to the oil reservoir and connected to the oil filter, wherein the second fitting portion is formed on an outer circumferential surface of the connection portion, wherein the first fitting portion and the second fitting portion have the fitting relation for the overlap distance in the radial direction of the oil passage, and wherein the clearance having the dimension is formed between the outer circumferential surface of the holding portion and the inner circumferential surface of the oil passage.

3. The structure for mounting a filter in a compressor according to claim 2, wherein the dimension of the clearance is smaller than diameter of the throttle hole over an entire circumference of the holding portion.

4. The structure for mounting a filter in a compressor according to claim 1, wherein one of the first fitting portion and the second fitting portion is a recess, wherein the other of the first fitting portion and the second fitting portion is a projection which is fitted in the recess.

5. The structure for mounting a filter in a compressor according to claim 1, wherein the compressor is a variable displacement type swash plate compressor, wherein the mounting member is a displacement control valve of the compressor, wherein the flow passage is a refrigerant passage through which refrigerant gas passes, wherein the displacement control valve includes a valve case having an end from which the valve case is inserted into the receiving hole, wherein the valve case has a port facing to the refrigerant passage, wherein the second fitting portion is formed on an outer circumferential surface of the valve case at a position adjacent to the end thereof, wherein the filter is connected to the valve case at a position adjacent to the end of the valve case by the fitting between the first fitting portion and the second fitting portion, and wherein the filter screen of the filter covers the port of the valve case.

6. The structure for mounting a filter in a compressor according to claim 5, wherein the refrigerant passage is a supply passage which communicates with a discharge chamber and a crank chamber of the compressor, wherein refrigerant gas under a discharge pressure passes through the supply passage, wherein the displacement control valve is either an externally controlled valve or an internally controlled valve, wherein when the displacement control valve is the externally controlled valve, the port is formed at the position adjacent to the end of the valve case, wherein the port communicates with the supply passage, wherein the externally controlled valve controls flow of the refrigerant gas flowing through the supply passage by operating a valve body of the externally controlled valve based on pressure in a suction pressure region and electromagnetic force controlled by an external signal, and wherein when the displacement control valve is the internally controlled valve, the port communicates with the discharge chamber, wherein the internally controlled valve controls flow of the refrigerant gas flowing through the supply passage by operating a valve body of the internally controlled valve based on the pressure in the suction pressure region.

7. The structure for mounting a filter in a compressor according to claim 5, wherein the holding portion is in the form of a tube whose opposite ends are opened, wherein the number of first fitting portions is two, wherein the two first fitting portions are located at different distances each other from the end of the valve case, wherein the number of second fitting portions is two, wherein the second fitting portions have the fitting relation with the first fitting portions, respectively.

8. The structure for mounting a filter in a compressor according to claim 1, wherein the receiving hole is an oil separation chamber for receiving therein an oil separator for separating oil contained in refrigerant gas under a discharge pressure from the refrigerant gas, wherein the fluid passage is an oil passage through which the oil separated in the oil separation chamber passes, wherein the filter screen covers the oil passage.

9. The structure for mounting a filter in a compressor according to claim 8, wherein the mounting member and the oil separator are inserted in the oil separation chamber separately.

10. The structure for mounting a filter in a compressor according to claim 8, wherein the mounting member is connected to the oil separator.

11. A compressor, comprising:

a filter having a filter screen and a holding portion for holding the filter screen;

a mounting member connected to the filter;

a housing;

a receiving hole formed in the housing for receiving therein the mounting member;

an axial retention means for restricting axial movement of the filter relative to the housing, the axial retention means comprising a first fitting portion formed on an inner circumferential surface of the holding portion, and a second fitting portion formed on an outer circumferential surface of the mounting member for having fitting relation with uneven surface to the first fitting portion for an overlap distance in a radial direction of the receiving hole, wherein the filter is fixedly attached to the axial retention means;

a fluid passage formed in the housing, wherein when the mounting member is received in the receiving hole with the first fitting portion and the second fitting portion having the fitting relation, the filter is disposed in the fluid passage; and a clearance having a dimension formed between an outer circumferential surface of the holding portion and an inner circumferential surface of the receiving hole, wherein minimum value of the dimension of the clearance is smaller than the overlap distance.

* * * * *